US006207364B1

(12) United States Patent
Takamuki et al.

(10) Patent No.: US 6,207,364 B1
(45) Date of Patent: Mar. 27, 2001

(54) THERMALLY DEVELOPABLE MATERIAL

(75) Inventors: Yasuhiko Takamuki; Takeshi Habu; Yasushi Usagawa, all of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/294,120

(22) Filed: Apr. 19, 1999

(30) Foreign Application Priority Data

Apr. 21, 1998 (JP) ..... 10-110788
Oct. 19, 1998 (JP) ..... 10-296747
Feb. 18, 1999 (JP) ..... 11-039888

(51) Int. Cl.[7] ..... G03C 1/498
(52) U.S. Cl. ..... 430/617; 430/531; 430/619
(58) Field of Search ..... 430/531, 935, 430/619, 617

(56) References Cited

U.S. PATENT DOCUMENTS 3,874,877 * 4/1975 Omichi et al. .
3,897,253 * 7/1975 Wilson .
5,223,384 6/1993 Ohbayashi et al. .
5,763,153 * 6/1998 Tsuzuki et al. ..... 430/619

FOREIGN PATENT DOCUMENTS 0803766 10/1997 (EP) .
0903627 3/1999 (EP) .

OTHER PUBLICATIONS

European Search Report EP 99 30 3021.

* cited by examiner

*Primary Examiner*—Thorl Chea
(74) *Attorney, Agent, or Firm*—Jordan B. Bierman; Bierman, Muserlian and Lucas

(57) ABSTRACT

A thermally developable material is disclosed. The material comprises a support both surfaces which are covered with a resin thermal shrinkage ratio of not more than 0.02% at 150° C. for 30 minutes, and an image forming layer comprising an organic silver. The thermally developable material is advantageous in transparent without staining and size repetition accuracy.

15 Claims, No Drawings

THERMALLY DEVELOPABLE MATERIAL

FIELD OF THE INVENTION

The present invention relates to a thermally developable material, in detail, to a thermally developable material which is colorless, transparent and excellent in repetitive size accuracy, and specifically to a thermally developable material for plate-making suitable for color printing.

BACKGROUND OF THE INVENTION

Conventionally, in the printing plate-making field, solution waste generated along with the wet process for image forming materials has caused problems. In recent years, in terms of environmental protection and space saving, a decrease in processing solution waste has been strongly demanded. Accordingly, a technique for a photo-thermal photographic material has been desired for application to photographic techniques in which effective exposure is possible employing a laser image setter, and a clear and sharp black image with high resolution can be formed. As such techniques, several methods are well known, which are described, for example, in U.S. Pat. Nos. 3,152,904 and 3,487,075, as well as in D. Morgan, "Dry Silver Photographic Materials", (Handbook of Imaging Materials, Marcel Dekker, Inc.) page 48, 1991, and the like. Because these photographic materials are commonly developed at a temperature of at least 80° C., they are called thermally developable materials.

The thermally developable material forms images employing a thermal development and comprises photosensitive silver halide, a non-photosensitive reducible silver source (an organic silver salt), a reducing agent for the silver source and a silver toning agent if necessary, usually in a form of dispersion in an (organic) binder matrix. When a developable material for printing plate-making is employed for color printing, a plurality of film sheets, which are subjected to color separation for each color, are usually employed. These are printed onto each of the machine plates; the resulting plates are superimposed, and employed for printing. When film sheets which are subjected to a plurality of color separation are not precisely superimposed, a phenomenon called doubling occurs. Therefore, with developable materials for printing plate-making, it is important that the sizes are always identical after development, that is, repetitive accuracy is required.

However, when the thermally developable material described above is developed at a temperature of not less than 80° C., conventionally, the above-mentioned repetitive size accuracy has not been sufficient, and when employed in color printing, they are not commercially viable. To overcome this problem, is described in Japanese Patent Publication Open to Public Inspection No. 10-10671 a technique in which resins such as polycarbonates, polyimides, etc., which tend not to be thermally contracted, are employed to prepare a support, instead of using conventionally employed polyethyleneterephthalates. This invention has been proven to assure the repetitive size accuracy. However, it has been found that when polyimide resin is used, as it is, to prepare a support, the developable material itself results in a brown tint, which is not commercially viable.

SUMMARY OF THE INVENTION

In view of the foregoing, the present invention has been accomplished. An object of the present invention is to provide a thermally developable material for printing plate-making, which is colorless and transparent, excellent in repetitive size accuracy, and suitable for color printing.

The present invention and embodiment thereof are described below.

A thermally developable material of the invention comprises a support both surfaces which are covered with a resin thermal shrinkage ratio of not more than 0.02% at 150° C. for 30 minutes, and an image forming layer comprising an organic silver.

A thermally developable material comprising a plastic support in which both surfaces are covered with a polyimide resin.

A thermally developable material comprising a plastic support in which both surfaces are covered with a resin containing water soluble group.

The resin containing water soluble group is a resin which comprises preferably at least one of polyimide structure and cyclo ring.

The thickness of the covering layer comprised of the polyimide resin on each side is preferably 0.25 to 4 $\mu$m.

The thermally developable material preferably comprises a photosensitive layer containing an organic silver salt and silver halide grains on the support.

The thermally developable material comprises a plastic support in which both surfaces are preferably covered with a resin having thermal shrinkage ratio of not more than 0.02% at developing temperature.

The resin to be coat the plastic film preferably has glass transition point not more than the developing temperature.

In the another embodiment, the resin may not have glass transition point, or have glass transition point not less than 100° C.

In the other embodiment, the resin is an inorganic and organic hybrid material containing silica. The hybrid material is preferably a polymer containing organosilsesquioxane unit or silicate unit in a structure.

The thickness of the resin coat in one side is preferably 0.25 to 4 $\mu$m.

DETAILED DESCRIPTION OF THE INVENTION

The present invention will be described in detail below.

Thermally developable materials are described in detail, as described above, for example, in U.S. Pat. Nos. 3,152,904 and 3,457,075, as well as in D. Morgan, "Dry Silver Photographic Material", D. Morgan and B. Shely, "Thermally Processed Silver Systems", (Imaging Processes and Materials), Neblette, 8th edition, edited by Sturge, V. Walworth, and A. Shepp, page 2, 1969, etc.

The thermal developable material is stable at room temperature and is developed by heating at high temperature after exposure. Silver image is formed by redox reaction between organic silver salt (works as an oxidant) and reducing agent caused by heating. The reaction goes on without providing processing liquid such as water from outside. The heating temperature is preferably 80 to 200° C., more preferably 100 to 150° C. Keeping these temperature, sufficient image density can be obtained within a short time, transportation is smooth without fusing binder. The thermal developable material may be processed by preheating at 50 to 80° C. just before the heat development. Term for development is preferably 10 to 60 seconds. Term for preheating is preferably 5 to 60 seconds.

The thermal developable material is thermally developed in the following way. The thermal developable material is transported between a heat drum which comprises heating devise having diameter not less than 200 mm and a transportation belt provided against the drum or device comprising several auxiliary transportation drum having diameter of 10 to 50 mm provided along with the heating drum keeping the image forming side contact with the heating drum in a heat insulating chamber. Or the thermal developable material is transported through a device having plurality of rollers positioned alternatively or in opposite position in a heated by heating means in a heated thermally insulating chamber, or the device comprising above mentioned rollers which comprises heating means by itself.

The support employed in the present invention is a film in which both surfaces of a plastic support are covered with a resin having thermal shrinkage ratio of not more than 0.02% at 150° C., 30 minutes. It is preferable that the resin is polyimide resin. The polyimide resin is a resin formed by condensation of acid dianhydrides and diamines, and is known to be a heat resistant resin. In the present invention, block polyimide resins and polyisoimide resins are preferably employed due to their ease in machining. Further polyimide resin containing cyclo ring compound in the structure component is preferably employed because it improves transparency.

The block polyimide resins are those which are prepared in such a manner that at least two of each of acid dianhydrides and diamines, which are resin components, are paired and block-polymerized. The preparation methods and the like are described in Japanese Patent Publication Open to Public Inspection No. 43-306232, U.S. Pat. No. 5,502,143, etc. The polyimide resins are structural isomers of polyimide and the preparation methods and the like are described in Kobunshi Kako (Polymer Processing), Volume 44, pages 109 to 118 (1995), etc.

The resin is synthesized by employing to introduce cyclo ring into the polyimide. an acid dianhydride or diamine, each of which contains cyclo ring for introducing cyclo ring into polyimide resin.

The molecular weight of the polyimide according to the invention is preferably 1,000 to 3,000,000 (weight average molecular weight).

Listed as acid dihydrides preferably employed in the present invention are pyromellitic dianhydride, 3,3',4,4'-biphenyltetracarboxylic dianhydride, 3,3',4,4'-benzophenonetetracarboxylic dianhydride, 3,3',4,4'-diphenylsulfonetetracarboxyluc dianhydride, 3,3',4,4'-diphenylethertetracarboxylic dianhydride, 3,3',4,4'-diphenylmethanetetracarboxylic dianhydride, 2,3,3',4'-biphenyltetracarboxylic dianhydride, 2,3,3',4'-diphenylethertetracarboxylic dianhydride, 2,3,3',4'-benzophenonetetracarboxylic dianhydride, 2,3,6,7-naphthalenetetracarboxylic dianhydride, 1,2,5,6-naphthalenetetracarboxylic dianhydride, 2,2-bis(3,4-dicarboxyphenyl)propanoic dianhydride, 2,2-bis(3,4-dicarboxyphenyl)propanoic dianhydride, 2,2-bis(2,3-dicarboxyphenyl)hexafluoropropanoic dianhydride, 4,4-bis(3,4-dicarboxyphenyl)diphenylsulfidic dianhydride, 2,2',3,3'-biphenyltetracarboxylic dianhydride, 3,4,9,10-perylenetetracarboxylic dianhydride, decahydronaphthalene-1,4,5,8-tetracroboxlyic dianhydride, 4,8-dimethyl-1,2,3,5,6,7-hexahydronaphthalene-1,2,5,6-tetracroboxlyic dianhydride, phenanthrene-1,8,9,10-tetracroboxlyic dianhydride, cyclopentane-1,2,3,4-tetracroboxlyic dianhydride, pyrrolidine-2,3,4,5-tetracroboxlyic dianhydride, pyrazine-2,3,5,6-tetracroboxlyic dianhydride, 1,1-bis(2,3-dicarboxyphenyl)ethanoic dianhydride, 1,1-bis(3,4-dicarboxyphenyl)ethanoic dianhydride, bis(2,3-dicarboxyphenyl)methanoic dianhydride, bicyclo(2,2,2)-octo-7-en-tetracarboxylic dianhydride, bicyclo(2,2,2)-octanetetracarboxylic dianhydride, norbornane-2,3,5,6-tetracarboxylic dianhydride, tetracyclo(4.4.0.1$^{2,5}$.1$^{7,10}$)dodecane-3,4,8,9-tetracarboxylic dianhydride, hexacyclo(6.6.6.1$^{3,6}$.1$^{10,13}$.0$^{2,7}$.0$^{9,14}$)heptadeccane-4,5,11,12-tetracarboxylic dianhydride and so on.

Listed as diamines preferably employed in the present invention are 3,3'-diaminodipehenyl ether, 3,4'-diaminodipehenyl ether, 4,4'-diaminodipehenyl ether, bis{4-(4-aminophenoxy)phenyl}ether, 3,3',4,4'-tetraaminodiphenyl ether, 4,4'-diaminophenyl thioether, 3,3'-diaminobiphenyl, 3,4'-diaminobiphenyl, 4,4'-diaminobiphenyl, o-tolidine, m-tolidine, 3,3'-dimethyl-4,4'-diaminobiphenyl, 3,3'-dimethoxy-4,4'-diaminobiphenyl, 4,4'-diaminoparaterphenyl, 4,4'bis(4-aminophenoxy)-biphenyl, 4,4'-bis(4-amino-2-trifluoromethylphenoxy)-biphenyl, 4,4'-bis(4-amino-3-trifluoromethylphenoxy)-biphenyl, 2,2',5,5'-tetrachloro-4,4'-diaminobiphenyl, 4,4'-diaminooctafluorobiphenyl, 4,4'-diaminohexafluorotolidine, 2,2'-dichloro-4,4'diamino-5,5'-dimethoxybiphenyl, 3,3'-dichloro-4,4'-diaminobiphenyl, 2,2',5,5'-tetrachlorobenzidine, 3,3',5,5'-tetramethylbenzidine, 3,3'-dihydroxy-4,4'-diaminobiphenyl, 3,3',4,4'-biphenyltetramine, 4,4'-diaminodiphenylsulfone, 3,3'-diaminodiphenylsulfone, 3,3'-dimethyl-4,4'-diaminodiphenylsulfone, 4,4'-dimethyl-3,3'-diaminodiphenylsulfone, bis{4-(aminophenoxy)phenyl}sulfone, bis{4-(3-aminophenoxy)phenyl}sulfone, bis{4-(2-aminophenoxy)phenyl}sulfone, bis{2-(4-aminophenoxy)phenyl}sulfone, bis{4-(4-amino-2-trifluoromethylphenoxy)phenyl}sulfone, bis{3-(amino-2-trifluoromethylphenoxy)phenyl}sulfone, 1.4-bis(4-aminophenoxy)benzene, 1,4-bis(4-amino-2-trifluoromethylphenoxy)benzene, 1,3-bis(4-aminophenoxy)benzene, 1,3-bis(3-aminophenoxy)benzene, 1,3-bis{1-(4-aminophenyl)-1-methylethylidene}benzene, 4,4'-diaminodiphenylmethane, bis(3-methyl-4-aminophenyl)methane, bis(3-ethyl-4-aminophenyl)methane, bis(3-chloro-4-aminophenyl)methane, bis(3,5-dimethyl-4-aminophenyl)methane, 1,2-bis(4-aminophenyl)ethane, 2,2-bis{4-(4-aminophenoxy)phenyl}propane, 2,2-bis{4-(2-aminophenoxy)phenyl}hexafluoropropane, 2,2-bis{4-(3-aminophenoxy)phenyl}hexafluoropropane, 2,2-bis{4-(4-aminophenoxy)phenyl}hexafluoropropane, 2,2-bis(4-aminophenyl)propane, 2,2-bis(4-aminophenyl)hexafluoropropane, 1,3-bis(4-aminophenyl)hexafluoropropane, 2,2-bis(3-hydroxy-4-aminophenyl)propane, 2,2-bis(3-hydroxy-4-aminophenyl)hexafluoropropane, 2,2-bis{4-(4-aminophenoxy)-3,5-dimethylphenyl}hexafluoropropane, 2,2-bis{4-(4-aminophenoxy)-3,5-ditrifluoromethylphenyl}hexafluoropropane, 2,2-bis{4-(4-amino-3-trifluoromethylphenoxy)phenyl}hexafluoropropane, 1,4-bis(4-aminophenyl)octafluorobutane, 1,5-bis(4-aminophenyl)decafluoropentane, 1,7-bis(4-aminophenyl)tetradecafluoropentane, 4,4'-diaminodiphenylsulfide, m-phenylenediamine, 4-chloro-m-phenylenediamine, 4-methyl-m-phnylenediamine, 2,4,6-trimethyl-m-phenylenediamine, p-phenylenediamine, 2,5-dichloro-p-phenylenediamine, 2,6-dichloro-p-phenylenediamine, 2-chloro-p-phenylenediamine, 2,5-dimethyl-p-phenylenediamine, 5-chloro2-methyl-p-phenylenediamine, 2,3,5,6-tetramethyl-p-phenylenediamine, diaminotoluene, diaminobenztrifluoride, 9,10-bis(4-aminophenyl) anthracene, 9,9-bis(4-aminophenyl)-10-hydroanthracene, 1,5-diaminoanthraquinone, 2,7-diaminofluorene, 9,9-bis(4-aminophenyl)fluorene, diaminosiloxane, 2,5-diaminopyridine, diaminobenzanilide, diaminobenzoate, 1,5-diaminonaphthalene, 1,4-diaminehexane, 2-methyl-1,4-diaminohexane, 2,2-bis(4-aminocyclohexyl)propane, 2,2-bis(4-aminocyclohexyl)hexafluoropropane, 1,3-diaminopentane, 2,5-diaminonorbornane, 2,3-diaminonorbornane, 2,6-diaminonorbornane, 4,4'-diaminobicyclohexysyl, bis-(4-aminocyclohexyl)sulfon, bis-(4-aminocyclohexyl)sulfide, bis-(4-aminocyclohexyl) oxide, 3,4-diamino-tetracyclo(4.4.0.$1^{2,5}$.$1^{7,10}$)dodecane etc.

Specific examples of preferred polyimide resins employed in the present invention are shown below. However, the present invention is not limited to these compounds below.

PI-1

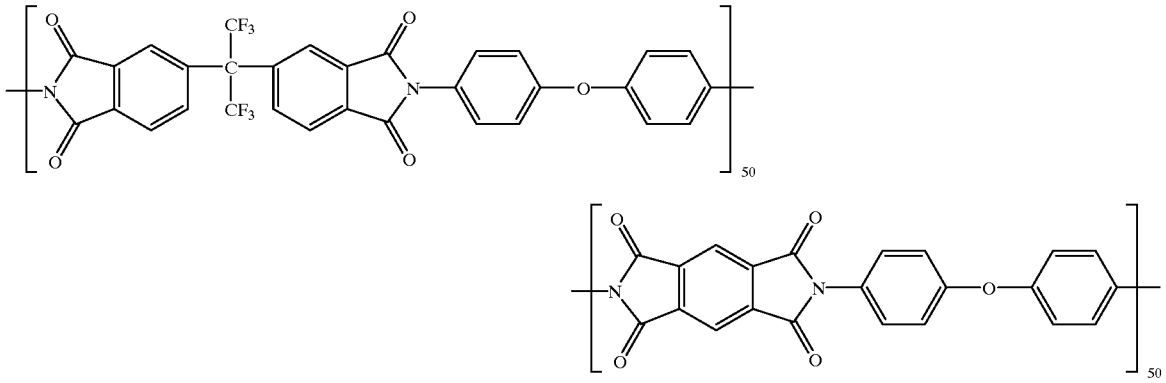

PI-2

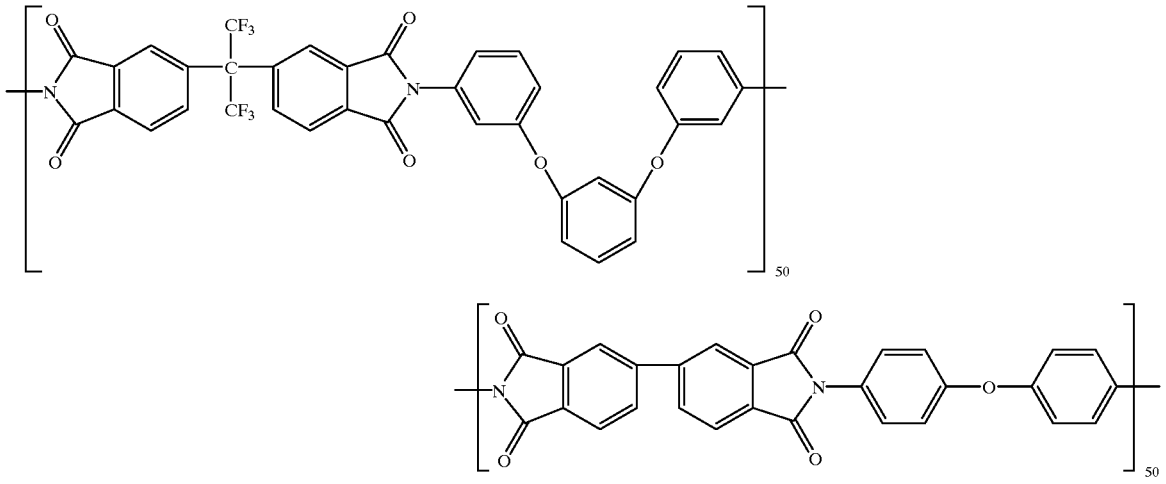

PI-3

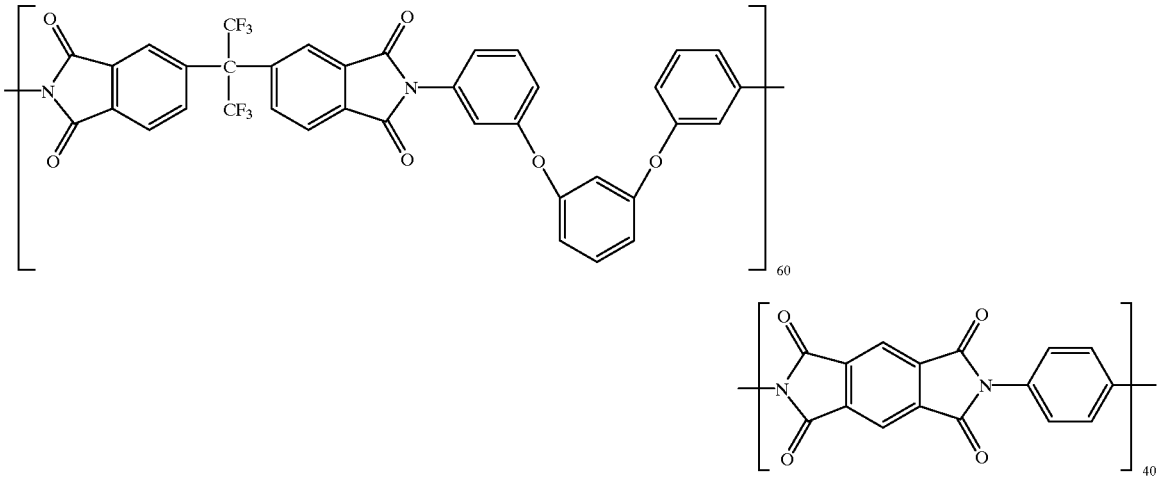

-continued
PI-4
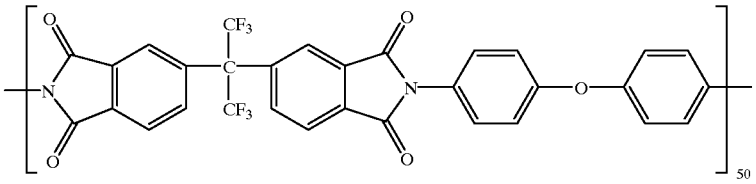
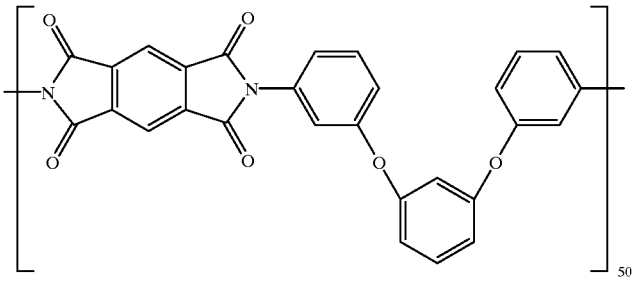
PI-5
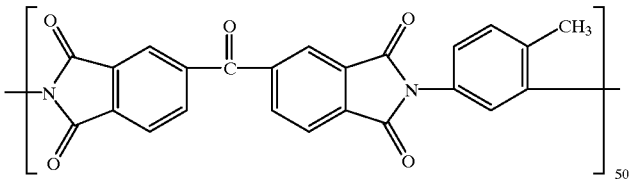
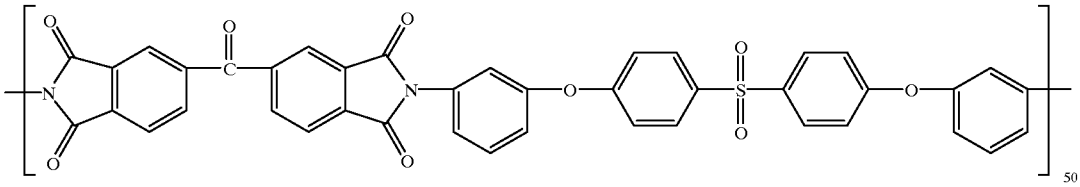
PI-6
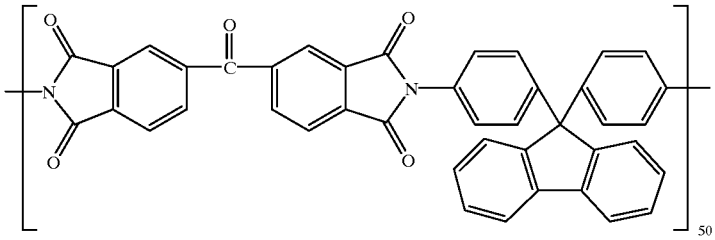
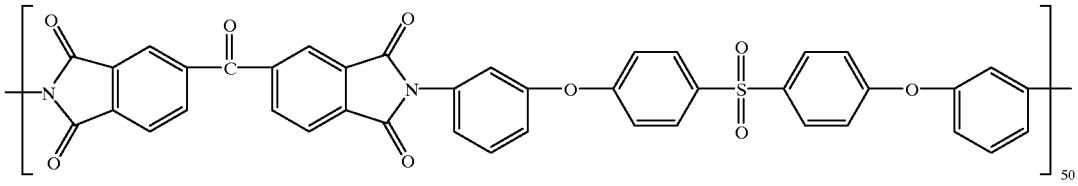
PI-7
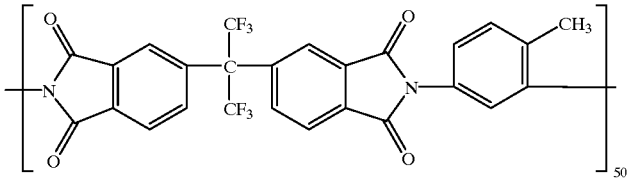

-continued
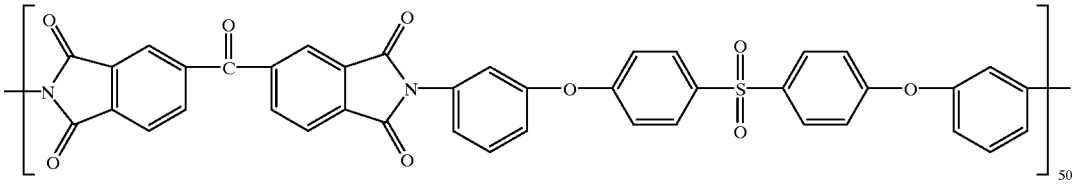
PI-8
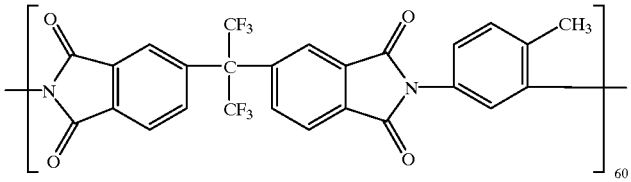
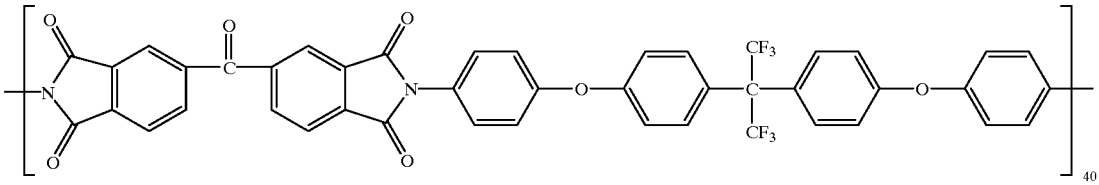
PI-9
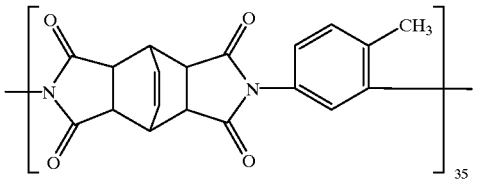
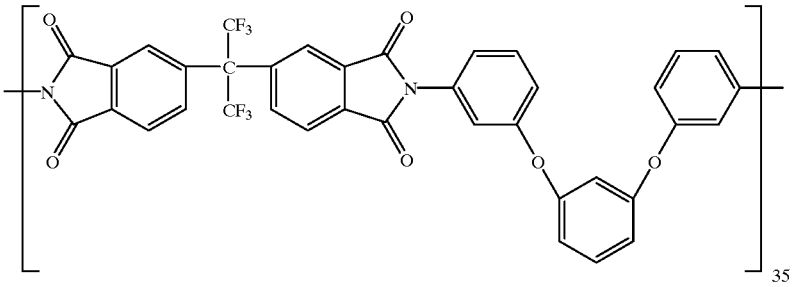
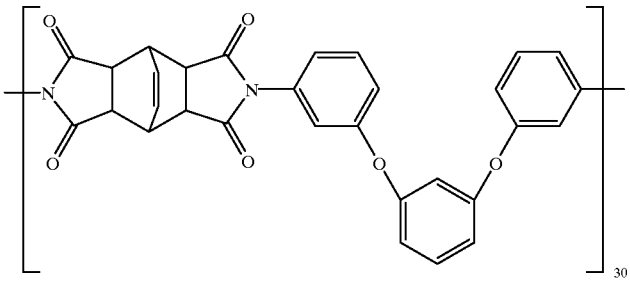
PI-10
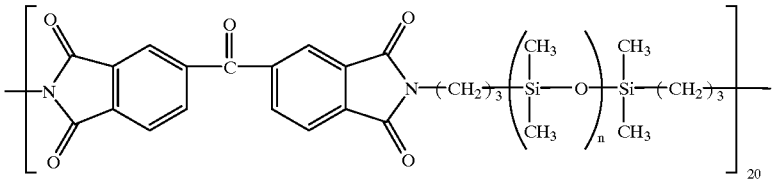

-continued
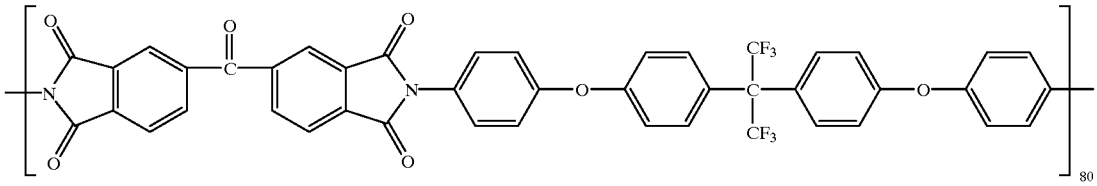
PI-11
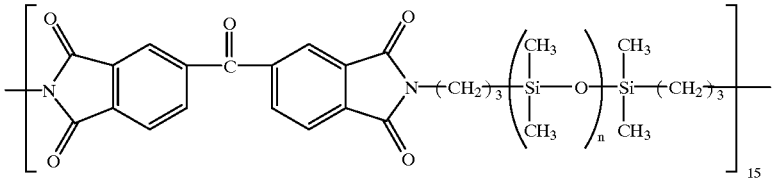
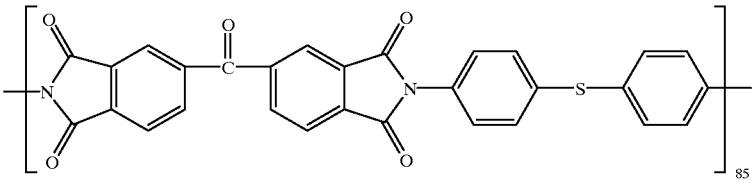
PI-12
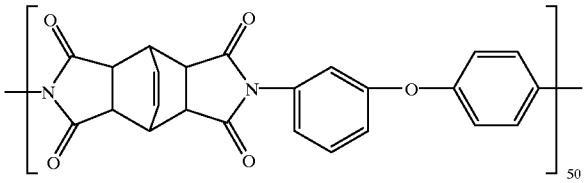
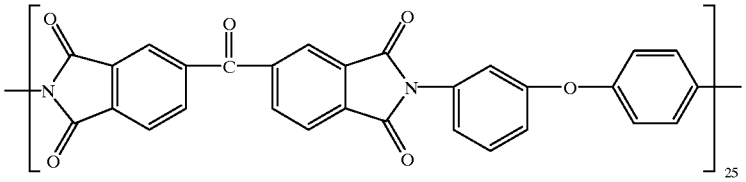
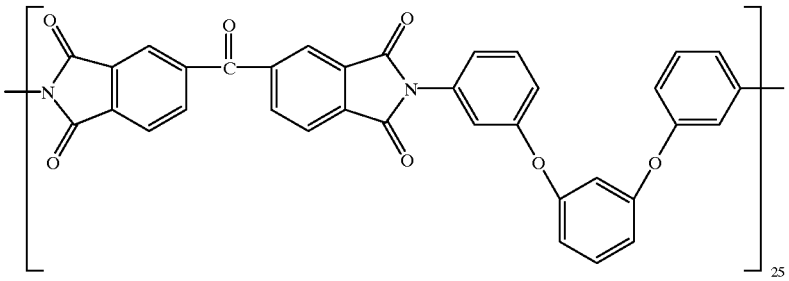
PI-13
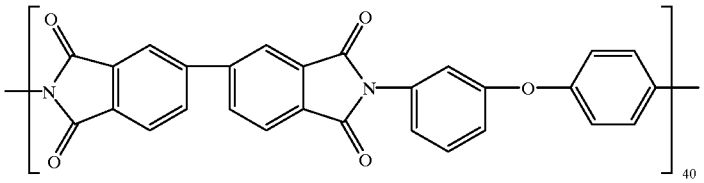
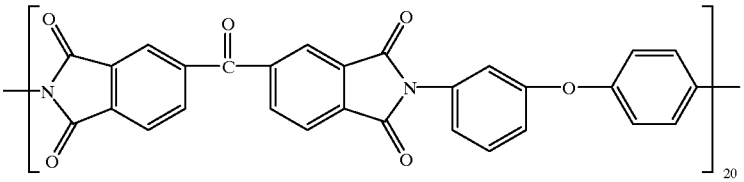

-continued
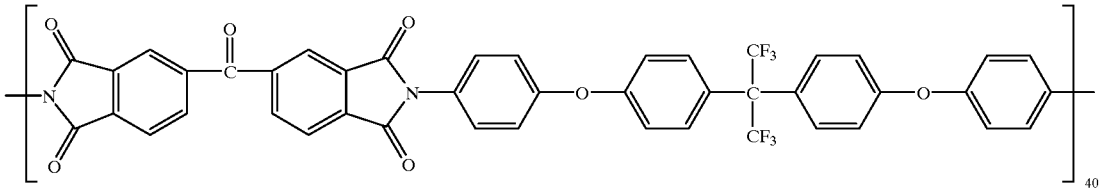
PI-14
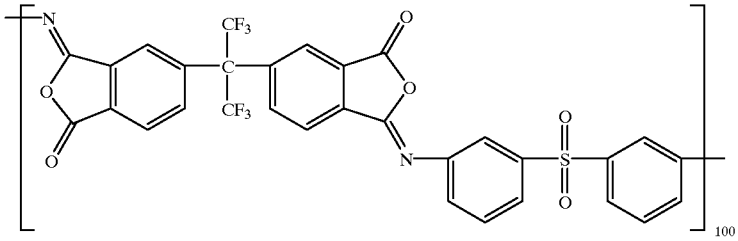
PI-15
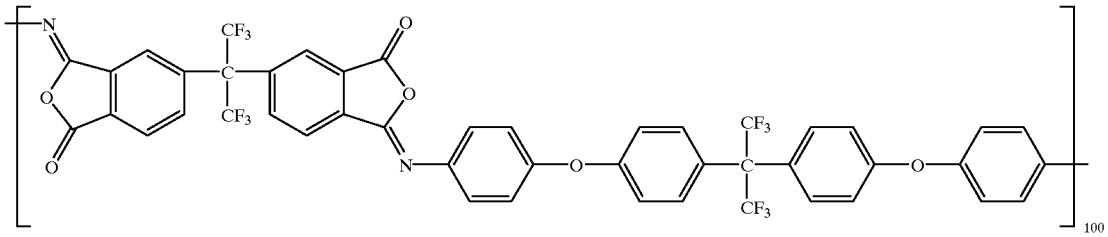
PI-16
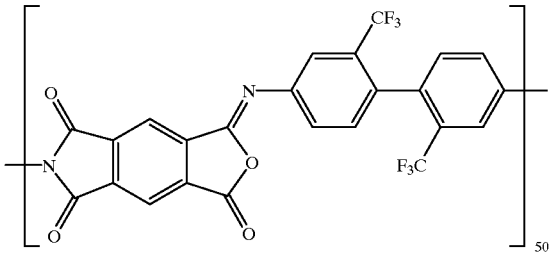
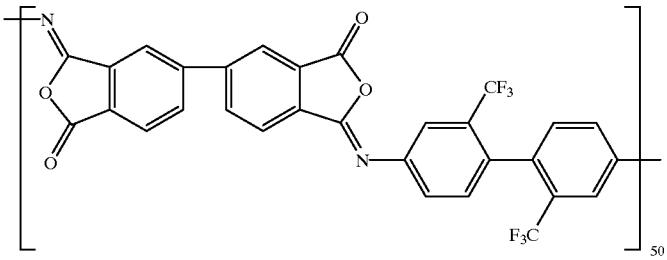
PI-17
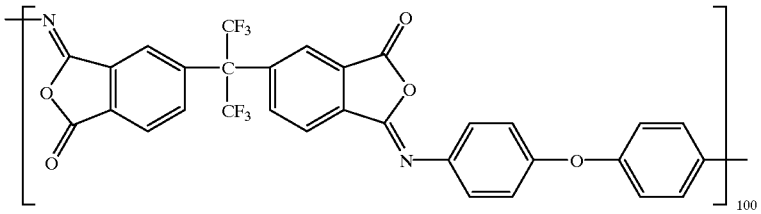

-continued

PI-18

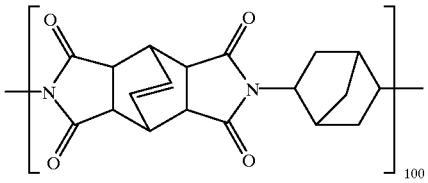

PI-19

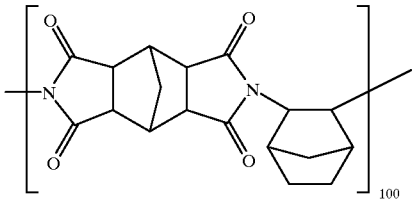

PI-20

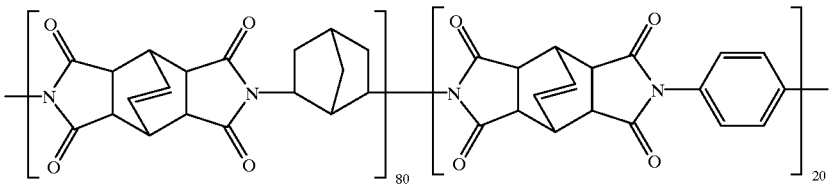

PI-21

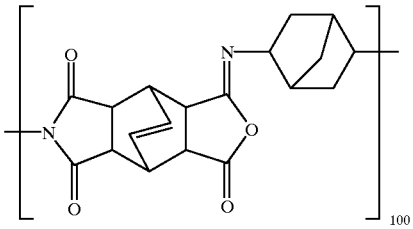

The above-mentioned polyimide resins are dissolved in polar solvents such as, for example, cyclohexanone, 1,4-dioxane, 1,3-dioxorane, dimethylformamide (DMF), diethylacetamide (DMAc), N-methylpyrrolidone (NMP), dimethylsulfoxide (DMSO), γ-butyrolactone and coated onto a plastic support and subsequently dried. The polyimide resins may be employed individually or in combination of a plurality of them. The thickness of the polyimide resin coating layer is preferably between 0.25 and 4 μm on each surface, and is more preferably between 0.5 and 3 μm. When the thickness is less than these values, heat resistance is insufficient and the repetitive size accuracy is degraded. On the contrary, when the thickness is greater, coloration is distinct and the product is not commercially viable.

In the present invention, other than the polyimide resin described above, preferable resultant is obtained by employing film which is a plastic support coated using the resin having such water soluble group as described below on both sides.

Water-soluble group in resin having water soluble group employed in the present invention is a hydrophilic functional group. Concrete examples includes an anion group such as carboxyl group, sulfonate group, phosphoric acid group or their salt, a cation group such as origoethyleneimino group, amino group, tertiary ammonium group, sulfoninum group, phosphoninum group and their salt, a nonion group such as hydroxyl group, origoethyleneoxide group, origopropyleneoxide group, silanol group, saccharide group such as glycosyl group. The most preferable example is a carboxyl group or is salt among above. At least one of the water soluble group per polymer chain should be contained and such an amount is preferable that the resin employed in the invention can be dispersed in water or mixture of water and water miscible organic solvent up to 70 wt %, or the resin is soluble not less than 1 wt % in water.

Examples of water miscibility organic solvent include alcohols such as methanol, ethanol and propanol, cellosolves such as methylcellosolve, ethylcellosolve, methyl acetate and butylcellosolve, esters of acetic acid such as methyl acetate and ethyl acetate, ketoamides such as dimethylformamide and dimethylacetamide, carbonates such as dimethyl carbonate and diethyl carbonate, and ketones such as acetone and methylethylketone.

The resin skeleton in the resin having water soluble group employed in the present invention is not limit especially, and its example includes poly acrylic resin, polystyrene resin, polyester resin, polyurethane resin, polycarbonate resin, polyethersulfone resin, polyvinylacetal resin, polyvinyl chloride resin, polyimide resin, poly cyclo ring resin. Among the above polyimide resin, poly cyclo ring resin are employed preferably.

Poly cyclo ring resin means a resin having at least one cyclo ring in the resin structure. Cyclo ring in the present invention is a monocyclic ring compound such as cyclobutane, cyclopentane, cyclohexane and cyclo heptane, or polycyclic ring saturated compound such as dicyclopentadiene or compound represented by following formula (1).

[Formula 15]

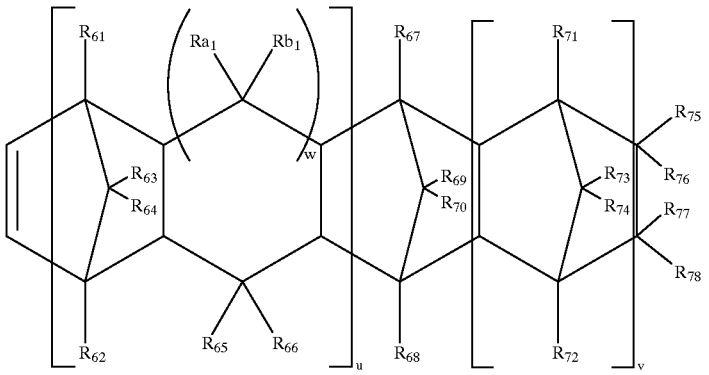

In the formula (1), u is 0 or 1, v is 0 or a positive integer, w is 0 or 1, $R_{61}$ to $R_{78}$ and $Ra_1$ and $Rb_1$ each represents a hydrogen atom, halogen atom or monovalent organic group independently. $R_{75}$ to $R_{78}$ may bonds mutually to form monocyclic ring or polycyclic ring, and the monocyclic ring or many ring may have double bond, and further $R_{75}$ and $R_{78}$ may form alkylidene group.

The concrete examples of polycyclic ring saturated compound represented by formula (1) include bicyclo[2.2.1]-2-heptene(norbornane), 5-phenylbicyclo[2.2.1]-2-heptene, 5-methyl-5-phenylbicyclo[2.2.1]-2-heptene, 5-methyl-5-carboxybenzilbicyclo[2.2.1]-2-heptene, tetracyclo[$4.4.0.1^{2,5}.1^{7,10}$]-3-dodecen, 8-methyl-8-carboxymethyl tetracyclo[$4.4.0.1^{2,5}.1^{7,10}$]-3-dodecen, 8-phenyl tetracyclo[$4.4.0.1^{2,5}.1^{7,10}$]-3-dodecen 8-methyl-8-phenyl tetracyclo[$4.4.0.1^{2,5}.1^{7,10}$]-3-dodecen, 8-ethylidene tetracyclo[$4.4.0.1^{2,5}.1^{7,10}$]-3-dodecen, hexacyclo[$6.6.1.1^{3,6}.1^{10,13}.0^{2,7}.0^{9,14}$]-4-heptadecene.

These compound may be employed solely or plurally in combination.

As for constitution except cyclo ring, there is not limit especially.

The resin having water-soluble group according to the present invention can be prepared by addition polymerization, condensation polymerization employing monomer having the water soluble group described above as the constituent.

The resin molecular weight having water soluble group employed in the present invention is not limit especially, and 1000–3000000 (weight average molecular weight) is preferable.

Concrete examples of the preferable compound are shown below. The present invention is not a thing limited to the following compound.

[Formula 16]

SP-1

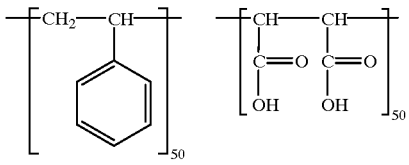

-continued

SP-2

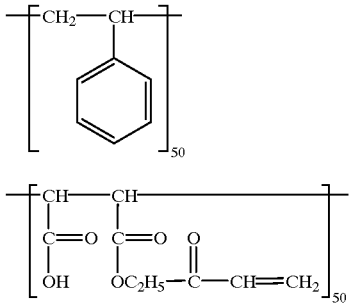

SP-3

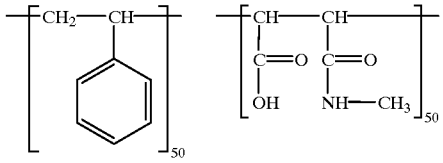

SP-4

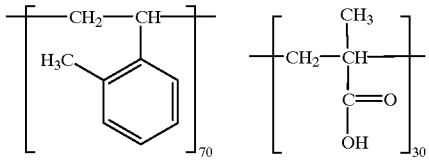

SP-5

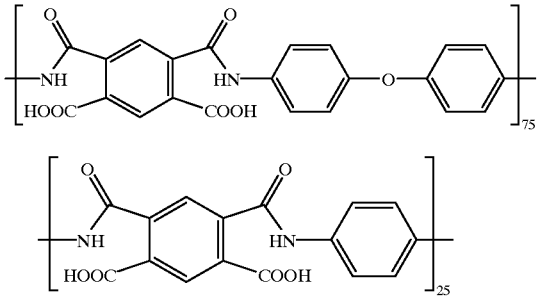

-continued

[Formula 17]

SP-6

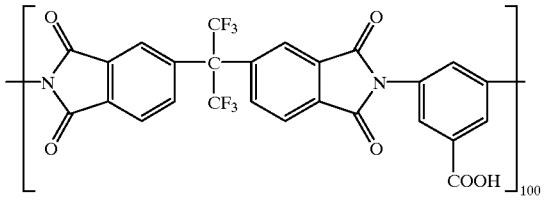

SP-7

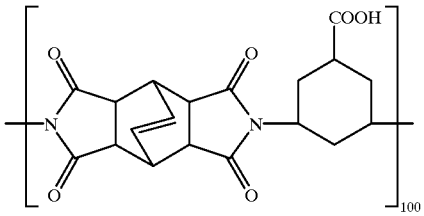

SP-8

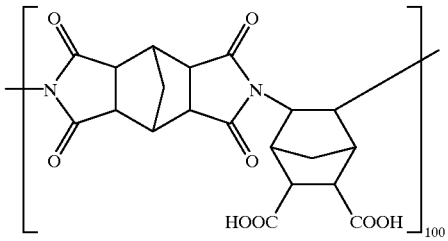

SP-9

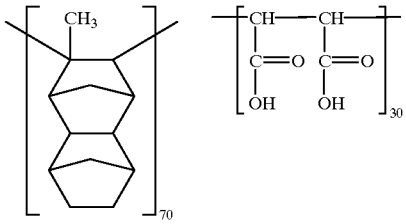

SP-10

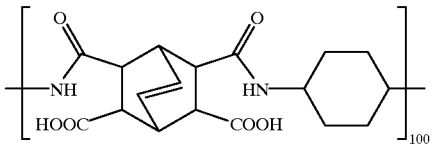

[Formula 18]

SP-11

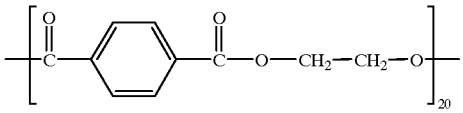

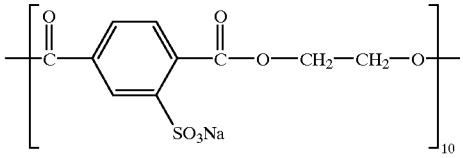

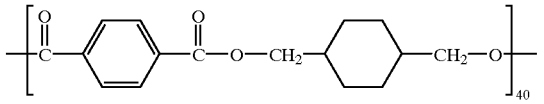

-continued

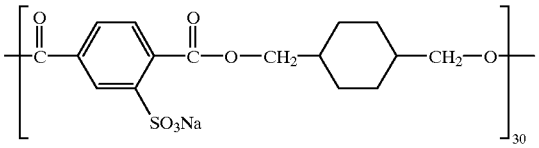

SP-12

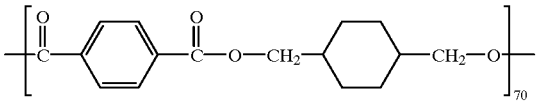

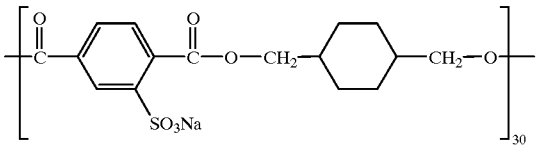

SP-13

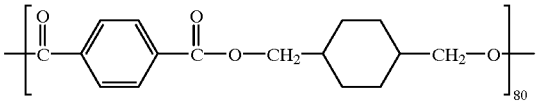

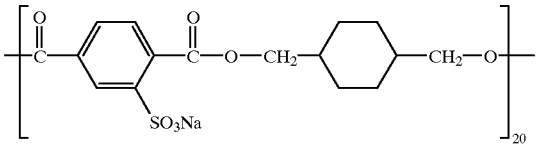

SP-14

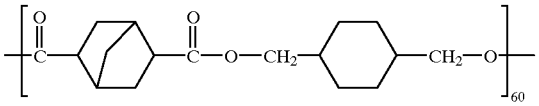

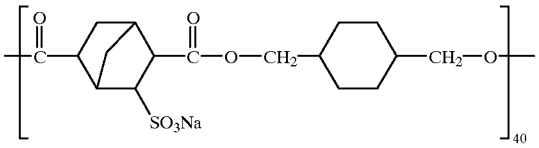

The resin having water soluble group employed in the invention is preferably dispersed or dissolved in water or mixture of water and water miscible organic solvent up to 70 wt %, then is coated on the plastic support and dried. The resin employed in the invention may be cross linked by using crosslinking agent such as polyfunctional epoxy compound, polyfunctional aziridine compound, polyfunctional isocyanate compound for the purpose of improving heat resistance.

For controlling physical characteristics such as brittleness of membrane or adhesive characteristics to support, poly acrylics resin, polystyrene-acrylics resin, polyesters resin or polyurethanes resin, having glass transition temperature of 50 degrees or less, may be used in combination so long as deteriorating the effect of the present invention.

The film thickness of the resin having water-soluble group of the present invention is preferably 0.25 $\mu$m to 4 $\mu$m and more preferably 0.5 $\mu$m to 3 $\mu$m per one side. Heat resistance is insufficient, and repeatability of dimension deteriorates when thinner and coloration is to stand out when too thicker than this. They are not preferable in practical use.

In the other embodiment, the resin to be coated on the plastic film preferably has thermal shrinkage ratio at 150° C. for 30 minutes is not more than 0.02% for both of longitudinal and horizontal direction. The thermal shrinkage ratio is dimensional shrink ratio after 30 minutes standing at 150° C., that is, (absolute value of (length after 30 minutes−length before standing))/(length before standing).

It is also preferable that the shrinkage ratio of the resin with a thickness as coated, and after standing for 30 minutes at the temperature of thermal development is not more than 0.02%

The resin has no glass transition temperature or has glass temperature of not less than 100° C. is also preferably employed. Glass transition point is obtained by measurement by means of scanning differential thermal analyzer (DSC).

Examples of the resin coating the support includes an organic material such as polycarbonate, polysulfon, polyacrylate, polyethersulfon, polyparabanic acid, polyamideimido, polyethylenenaphthalate, polyetheretherketone, polyimide, polymethylmethacrylate and polynorbornane, organic inorganic material containing such as silica, aluminum and titanium. The resin organic inorganic hybrid material containing silica is preferably employed. The polymer containing organosilsesquioxane or silicate unit in the structure is preferably employed in view of easy preparation.

The organosilsesquioxane unit is a trifunctional unit represented by $RSiO_{3/2}$ (wherein R is a hydrogen atom or an organic group). Examples of the compound containing the unit includes, those have a basket form, concretely, hexakis (hydridosilsesquisoxane)[$(H\ SiO_{3/2})_6$], octakis (hydridosilsesquisoxane)[$(H\ SiO_{3/2})_8$], decakis (hydridosilsesquisoxane)[$(H\ SiO_{3/2})_{10}$], dodecakis (hydridosilsesquisoxane)[$(H\ SiO_{3/2})_{12}$], tetradecakis (hydridosilsesquisoxane)[$(H\ SiO_{3/2})_{14}$], and hexadecakis (hydridosilsesquisoxane)[$(H\ SiO_{3/2})_{16}$].

The polymer can be obtained by hydrosilyl polymerizing these compound singly or in combination with acetylene, monosubstituted acetylene or bis(substituted ethynyl) compound and/or ethylene, monosubstituted ethylene or bis (substituted ethenyl) compound, for example, with reference to JP OPI Nos. 9-296043 or 9-296044. The polymer may be obtained by radical polymerization of monomer which protrudes vinyl group from the basket formed structure of the organosilsesquioxane. This is synthesized with reference to J. D. Lichtenhan et al., Macromolecules, vol. 28, pp 8435–8437 (1995) or T. S. Haddad et al., Macromolecules, vol. 29, pp 7302–7304.

The silicate unit is a tetrafunctional unit represented by ($SiO_2$). The polymer containing the unit can be synthesized by hydrolysis or condensation of polymer having alkoxysilyl with alkoxysilane. JP OPI 9-296044 is made to reference.

The organosilsesquioxane unit or the silicate unit may be employed singly or in combination. The monofunctional triorganosilhemioxane unit represented by $R_3SiO_{0.5}$ or difunctional diorganosiloxane unit represented by $R_2SiO$ may be employed in combination, so long as deteriorating the effect of the present invention.

The total amount of the triorganosilhemioxane unit or diorganosiloxane unit is preferably not less than 20 mol % with respect to whole Si unit, more preferably 50 mol % in view of thermal shrinkage ratio in case of employing the triorganosilhemioxane unit or diorganosiloxane unit with organosilsesquioxane unit or silicate unit in combination.

The preferable examples are described below.

T-1

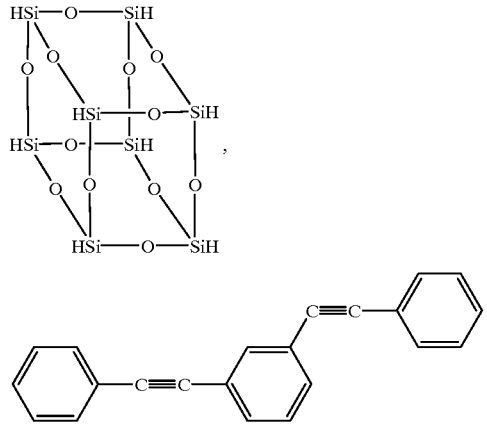

1:1 polymer, Mw = 21,300, Tg = around 200° C.

T-2

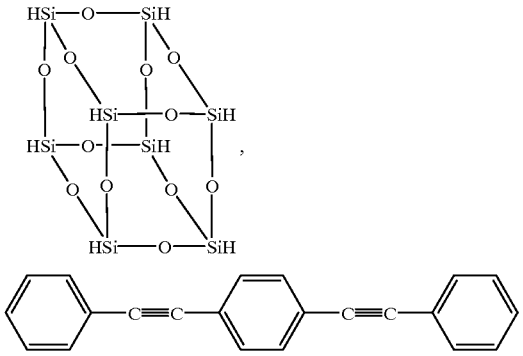

1:1 polymer, Mw = 36,000, Tg = not found

T-3

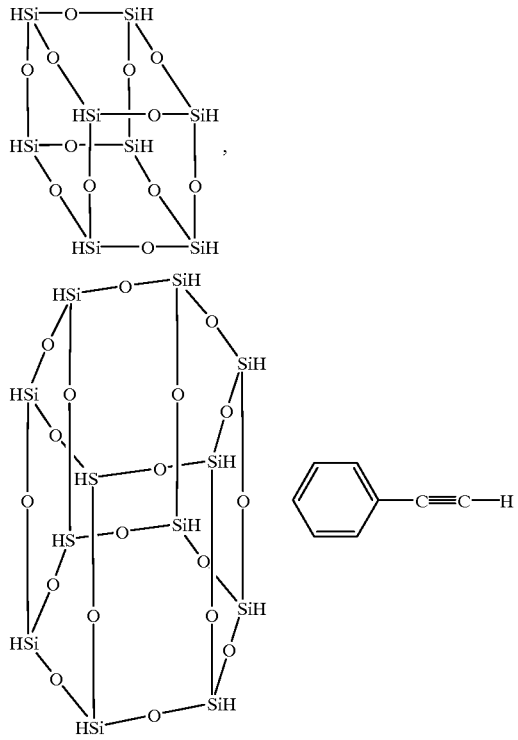

-continued

3:2:5 polymer, Mw = around 32,000, Tg = around 220° C.

T-4

$(HSiO_{3/2})_{10}$, $(HSiO_{3/2})_{12}$, $(HSiO_{3/2})_{14}$ and $(HSiO_{3/2})_{16}$

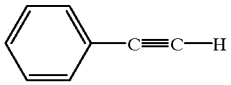

2:21:20:7:50 polymer, Mw = around 34,000, Tg = around 210° C.

T-5

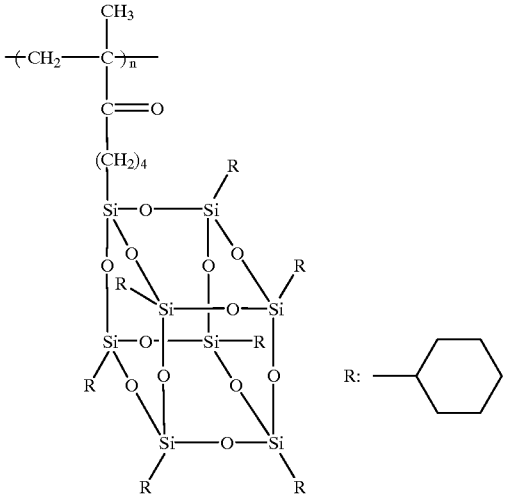

Mw = 222,000, Tg = not found

T-6

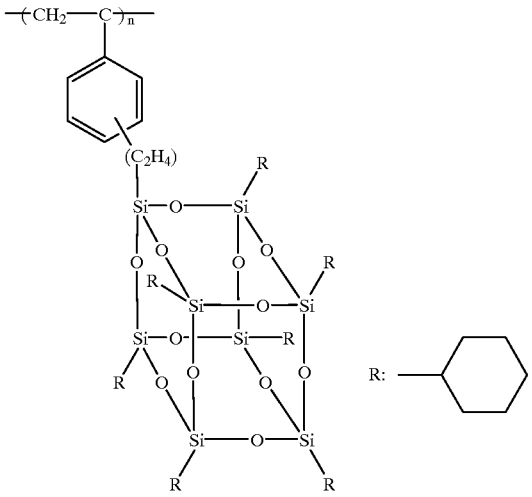

Mw = 430,000, Tg = not found

T-7

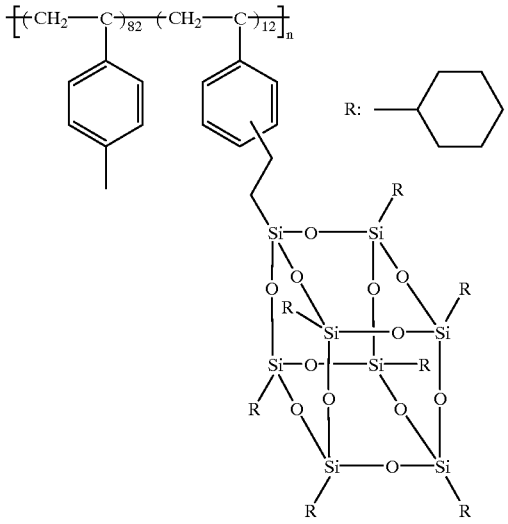

Mw = 10,000, Tg = 115° C.

T-8

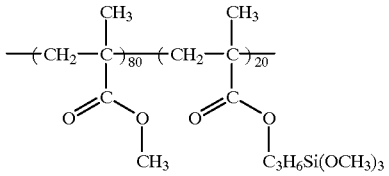

Mixture of 1:4:1 by weight, partial condensed, Tg = 120° C.

T-9

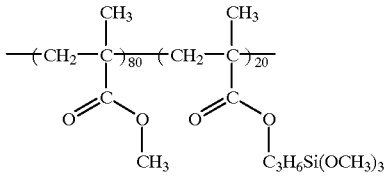

Mixture of 1:1:1:2 by weight, partial condensed, Tg = 140° C.

The resin mentioned above can be coated on the plastic support and dried. The resin can be dissolved by employing general solvent such as cyclohexane, 1,4-dioxane, 1,3-dioxolane, dimethylformamide (DMF), dimethylacetoamide (DMAc), N-methylpyrroridone (NMP), dimethylsulfoxide (DMSO), γ-butyllactone, methanol, ethanol, tetrahydrofurane (THF), benzene, toluene, and cyclohexane. The resin can be coated by fused extrusion with the support resin simultaneously in case of thermoplastic resin. The plural resins may be employed in combination. Thickness of the resin coating is preferably 0.25 to 4 μm, more preferably 0.5 to 3 μm in view of sufficient heat resistance and repetition dimensional accuracy and avoiding undesirable staining.

When providing the resin, especially polyimide resin or a resin having water-soluble group on plastic support, it is preferable to coat directly on plastic support, the polyimide resin of the present invention or water soluble group may be provided after providing adhesive layer for the purpose of improving adhesive characteristics with plastic support. The resin may be provided by laminating resin film or coating resin.

The surface of the support or the surface of the adhesive layer may be subjected by flame treatment, corona discharge treatment, plasma discharge treatment and so on, if demanded, when the support is covered or coated with the resin.

It is preferable to provide an image forming layer or an anti-halation layer on the covered resin. Prior to providing these layers, a subbing layer may be provided on the covered resin for the purpose of improving adhesion to these layer or giving antistatic characteristics. The covered resin may be given a function such as antistatic characteristics or adhesive improving characteristics. The covered resin is provided for the purpose of decreasing heat shrink problem only but not improving antistatic characteristics usually given by the subbing layer.

Examples of the employed material for the adhesive layer or the subbing layer includes polyacrylate resin, styrene resin, styrene-butadiene resin, polyester resin polyurethane resin, polyvinylacetal resin, polyvinylalcohol resin or gelatin which is selected in accordance with the characteristics of both layers to superimpose the adhesive layer or the subbing layer. These may be used two or more in combination.

Into the adhesive layer or the subbing layer metal oxide, electroconductive polymer, surfactant such as aninonic surfactant and cationic surfactant may be added for the purpose of giving antistatic characteristics. Metal oxide, electroconductive polymer or surfactant may be added to the covered resin when antistatic characteristics or adhesive improving characteristics are given to the covered resin.

When the subbing layer is coated, the resin covered surface may be subjected by flame treatment, corona discharge treatment, plasma discharge treatment and so on, if demanded.

The covered resin has the same compositions on both sides. The thickness of the covered resin is preferably the same on both sides.

The compositions of the subbing layers on both sides may be the same or different. The thickness of the subbing layers on both sides may be the same or different.

Employed as plastic supports which are coated with the polyimide resins employed in the present invention are preferably polyethylene terephthalate (PET), polyethylene naphthalate (PEN) or styrene series polymers (SPS) having a syndiotactic structure. The thickness of the support is to be between about 50 and about 300 $\mu$m, and is preferably between 70 and 180 $\mu$m.

PET is that in which the entire components of polyester are composed of polyethylene terephthalate. Other than polyethylene terephthalate, polyesters may also be employed, which comprise, in an amount of not more than 10 mole percent of the entire polyesters, polyester components modified with terephthalic acid, naphthalene-2,6-dicarboxylic acid, isophthalic acid, butylene dicarboxylic acid, 5-sodiumsulfoisophthalic acid, adipic acid, etc. as acid components, and ethylene glycol, propylene glycol, butanediol, cyclohexanedimethanol, etc. as glycol components.

PEN is that in which the entire polyester components are composed of polyethylene-2,6-naphthalate. However, other than polyethylene-2,6-naphthalate, polyesters may also be employed, which comprise, in an amount of not more than 10 mole percent of entire polyesters, polyester components modified with terephthalic acid, naphthalene-2,6-dicarboxylic acid, naphthalene-1.4-dicarboxylic acid, naphthalene-1,5-dicarboxylic acid, naphthalene-2,7-dicarboxylic acid, isophthalic acid, 5-sodiumsulfoisophthalic acid, butylenedicarboxylic acid, etc. as acid components, and ethylene glycol, propylene glycol, butanediol, cyclohexanedimethanol, etc. as glycol components.

SPS is different from common polystyrene (atactic polystyrene) and polystyrene which has stereoscopic regularity. A structure's portion having stereoscopic regularity is called a racemo chain. The more the portion having regular structures, such as two chains, three chains, five chains or more, increases, the more it is preferred. In the present invention, it is preferred that in terms of the number of the racemo chains, two chains are to comprise at least 85 percent of the structure; three chains are to comprise at least 75 percent; five chains are to comprise at least 50 percent; and chains of more than five are to comprise at least 30 percent.

The number of chains of the main chain can be accurately measured by employing the carbon atom in the first position of a benzene ring employing $^{13}$C-NMR.

SPS compositions which are useful for the present invention, that is, polystyrene series resins having a syndiotactic structure, are obtained by polymerizing monomers, as those described above as raw material monomers, while employing catalysts, for example, condensation products of titanium compounds with organic aluminum compounds, and specifically trialkylaluminum compounds.

There is no limitation on the molecular weight of SPS and SPS compositions which are useful for the present invention. However, the molecular weight (weight average molecular weight) is preferably in the range of 10,000 to 3,000,000, and in terms of ease of film casting, is preferably in the range of 30,000 to 1,500,000. Further, at the time, a molecular weight distribution (number average molecular weight/weight average molecular weight) is preferably between 1.5 and 8. The molecular weight described herein may be adjusted by mixing those having different molecular weight.

Polymerization to prepare SPS can be carried out in accordance with a method described in Japanese Patent Publication Open to Public Inspection No. 3-131843.

SPS prepared employing styrene is preferably an individual SPS. Furthermore, a rate of crystallization can be controlled by mixing (that is, forming a stereocomplex), as compositions containing SPS, SPS with styrene series polymers (IPS) having an isotactic structure in which the main chain is a meso chain, in which the strength of the film can thus be increased.

When SPS is mixed with IPS, the rate described herein depends on the degree of mutual stereoscopic regularity. However, both may be mixed in ratios of 30:70 to 99:1.

SPS film may be cast in almost the same manner as polyester. These plastics may be employed individually or in combination and may be employed in a multilayered structure.

Methods known in the art can be employed as methods for casting film employed for the support regarding the present invention and subbing thereof. However, is preferably employed a method described in paragraphs (0030) to (0070) of Japanese Patent Publication Open to Public Inspection No. 9-50094.

Onto the support of the present invention, is coated a photosensitive layer comprising photosensitive silver halide grains and organic silver salts. An image forming layer containing only organic silver salt but not photosensitive silver halide grains may be provided. Thickness of the image forming layer or the photosensitive image forming layer is preferably 1.0 to 20. μm, and more preferably 1.5 to 10 μm.

The silver halide grains used in the present invention function as a light sensor. In the present invention, in order to minimize the translucence after image formation and to obtain excellent image quality, the average grain size is preferably minute. The average grain size is preferably not more than 0.1 μm; is more preferably between 0.01 and 0.1 μm, and is most preferably between 0.02 and 0.08 μm. The average grain size as described herein implies the ridge line length of a silver halide grain when it is a so-called regular crystal which is either cubic or octahedral. When the grain is not a regular crystal, for example, when it is a spherical, cylindrical, or tabular grain, the grain size is the diameter of a sphere having the same volume as each of those grains. Furthermore, silver halide is preferably monodispersed. The monodisperse as described herein means that the degree of monodispersibility obtained by the formula described below is not more than 40 percent. The more preferred grains are those which exhibit the degree of monodispersibility is not more than 30 percent, and the particularly preferred grains are those which exhibit a degree of monodispersibility is between 0.1 and 20 percent.

Degree of monodispersibility=(standard deviation of grain diameter)/(average of grain diameter)×100

In the present invention, the average grain diameter is preferably not more than 0.1 μm, and grains are preferably monodispersed. When grains are formed in this range, the graininess of images is also improved.

There is no particular limitation on the silver halide grain shape. However, a high ratio occupying a Miller index {100} plane is preferred. This ratio is preferably at least 50 percent; is more preferably at least 70 percent, and is most preferably at least 80 percent. The ratio occupying the Miller index [100] plane can be obtained based on T. Tani, J. Imaging Sci., 29, 165 (1985) in which adsorption dependency of a {111} plane and a {100} plane is utilized.

Furthermore, another preferred silver halide shape is a tabular grain. The tabular grain as described herein is a grain having an aspect ratio represented by r/h of not less than 3, wherein r represents a grain diameter in μm obtained as the square root of the projection area, and h represents thickness in μm in the vertical direction. Of these, the aspect ratio is preferably between 3 and 50. The grain diameter is preferably not more than 0.1 μm, and is more preferably between 0.01 and 0.08 μm. These are described in U.S. Pat. Nos. 5,264,337, 5,314,789, 5,320,958, and others, by which desired tabular grains can readily be prepared. When these tabular grains are used, image sharpness is further improved.

The composition of silver halide is not particularly limited and may be any of silver chloride, silver chlorobromide, silver chloroiodobromide, silver bromide, silver iodobromide, or silver iodide. The photographic emulsion employed in the present invention can be prepared employing methods described in P. Glafkides, "Chimie et Physique Photographique" (published by Paul Montel, 1967), G. F. Duffin, "Photographic Emulsion Chemistry" (published by The Focal Press, 1966), V. L. Zelikman et al., "Making and Coating Photographic Emulsion" (published by The Focal Press, 1964), etc. Namely, any of several acid emulsions, neutral emulsions, ammonia emulsions, and the like may be employed. Furthermore, when grains are prepared by allowing soluble silver salts to react with soluble halide salts, a single-jet method, a double-jet method, or combinations thereof may be employed. The resulting silver halide may be incorporated into an image forming layer utilizing any practical method, and at such time, silver halide is placed adjacent to a reducible silver source. Furthermore, silver halide may be prepared by converting a part or all of the silver in an organic silver salt formed through the reaction of an organic silver salt with halogen ions into silver halide. Silver halide may be previously prepared and the resulting silver halide may be added to a solution to prepare the organic silver salt, or combinations thereof may be used, however the latter is preferred. Generally, the content of silver halide in organic silver salt is preferably between 0.75 and 30 weight percent.

Silver halide employed in the present invention is preferably comprised of ions of metals or complexes thereof, in transition metal belonging to Groups VI to X of the Periodic Table. As the above-mentioned metals, preferred are W, Fe, Co, Ni, Ru, Rh, Pd, Re, Os, Ir, Pt and Au.

These metals may be incorporated into silver halide in the form of complexes. In the present invention, regarding the transition metal complexes, six-coordinate complexes represented by the general formula described below are preferred.

General formula $(ML_6)^m$:

wherein M represents a transition metal selected from elements in Groups VIB, VIIB, VIII, and IB of the Periodic Table; L represents a coordinating ligand; and m represents −1, −2, −3 or −4.

Specific examples represented by L include halides (fluorides, chlorides, bromides, and iodides), cyanides, cyanates, thiocyanates, selenocyanates, tellurocyanates, each ligand of azido and aquo, nitrosyl, thionitrosyl, etc., of which aquo, nitrosyl and thionitrosyl are preferred. When the aquo ligand is present, one or two ligands are preferably coordinated. L may be the same or different.

The particularly preferred specific example of M is rhodium (Rh), ruthenium (Ru), rhenium (Re) or osmium (Os).

Specific examples of transition metal ligand complexes are described below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[CrCl_6]^{4-}$
7: $[Ru(NO)Cl_5]^{2-}$
8: $[RuBr_4(H_2O)]^{2-}$
9: $[Ru(NO)(H_2O)Cl_4]^{-}$
10: $[RhCl_5(H_2O)]^{2-}$
11: $[Re(NO)Cl_5]^{2-}$
12: $[Re(NO)CN_5]^{2-}$
13: $[Re(NO)ClCN_4]^{2-}$
14: $[Rh(NO)_2Cl_4]^{-}$
15: $[Rh(NO)(H_2O)Cl_4]^{-}$
16: $[Ru(NO)CN_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$

One type of these metal ions or complex ions may be employed and the same type of metals or the different type of metals may be employed in combinations of two or more types.

Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation.

The addition may be carried out several times by dividing the added amount. Uniform content in the interior of a silver halide grain can be carried out. As described in Japanese Patent Publication Open to Public Inspection No. 63-29603, 2-306236, 3-167545, 4-76534, 6-110146, 5-273683, etc., incorporation can be carried out so as to result in distribution formation in the interior of a grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

In the present invention, organic silver salts are reducible silver sources and preferred are organic acids and silver salts of hetero-organic acids having a reducible silver ion source, specifically, long chain (having from 10 to 30 carbon atoms, and preferably from 15 to 25 carbon atoms) aliphatic carboxylic acids and nitrogen-containing heterocyclic rings.

Organic or inorganic silver salt complexes are also useful in which the ligand has a total stability constant for silver ion of 4.0 to 10.0.

Examples of preferred silver salts are described in Research Disclosure, Items 17029 and 29963, and include the following; organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-carboxypropyl)-3,3-dimethyl-thiourea, etc.); silver complexes of polymer reaction products of aldehyde with hydroxy-substituted aromatic carboxylic acid (for example, aldehydes (formaldehyde, acetaldehyde, butylaldehyde, etc.)), hydroxy-substituted acids (for example, salicylic acid, benzoic acid, 3,5-dihydroxybenzoic acid, 5,5-thiodisalicylic acid, silver salts or complexes of thions (for example, 3-(2-carboxyethyl)-4-hydroxymethyl-4-(thiazoline-2-thion and 3-carboxymethyl-4-thiazoline-2-thion)), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides.

In the present invention, of these, the preferred organic silver salts are silver behenate, silver stearate, and silver arachidate. These silver salts may be used in combination.

Organic silver salts can be prepared by mixing a water-soluble silver compound with a compound which forms a complex with silver, and employed preferably are a normal precipitation, a reverse precipitation, a double-jet precipitation, a controlled double-jet precipitation as described in Japanese Patent Publication Open to Public Inspection No. 9-127643, etc.

In the present invention, organic silver salts preferably have an average grain diameter of 1 $\mu$m and are monodispersed. The average diameter of the organic silver salt as described herein is, when the grain of the organic salt is, for example, a spherical, cylindrical, or tabular grain, a diameter of the sphere having the same volume as each of these grains. The average grain diameter is preferably between 0.01 and 0.8 $\mu$m, and is most preferably between 0.05 and 0.5 $\mu$m. Furthermore, the monodisperse as described herein is the same as silver halide grains and preferred monodispersibility is between 1 and 30 percent. In the present invention, the organic silver salts are preferably composed of monodispersed grains with an average diameter of not more than 1 $\mu$m. When grains are prepared within this range, high density images can be obtained. In the invention, a tabular grain having an aspect ratio abbreviated as AR), which is a quotient obtained by the following equation, is not less than 3 is preferred.

$$AR = \text{Average grain diameter } (\mu m)/\text{thickness } (\mu m)$$

The above mentioned organic silver crystal is pulverized and dispersed with binder and surfactant by means of ball mills etc. to obtain the organic silver in such shape mentioned above.

In the present invention, the total amount of silver halides and organic silver salts is preferably between 0.5 and 2.2 g per $m^2$ in terms of silver amount for the purpose of improving haze of the light sensitive materials. When these are prepared within this range, high contrast images can be obtained. Furthermore, the amount of silver halides to that of total silver is not more than 50 percent by weight; is preferably not more than 25 percent, and is more preferably between 0.1 and 15 percent.

A reducing agent is preferably incorporated into the thermally developable material to which the present invention is applied. Examples of suitable reducing agents are described in U.S. Pat. Nos. 3,770,448, 3,773,512, and 3,593,863, and Research Disclosure items 17029 and 29963, and include the following.

Aminohydroxycycloalkenone compounds (for example, 2-hydroxypiperidino-2-cyclohexane); esters of amino reductones as the precursor of reducing agents (for example, pieridinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl) methylsulfone); sulfhydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquionoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones.

Of these, particularly preferred reducing agents are hindered phenols.

As hindered phenols, listed are compounds represented by the general formula (A) described below.

General formula (A)

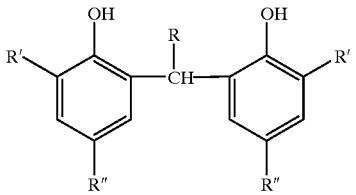

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 carbon atoms (for example, methyl, ethyl, t-butyl).

Specific examples of the compounds represented by the general formula (A) are described below. However, the present invention is not limited to these examples.

A-1

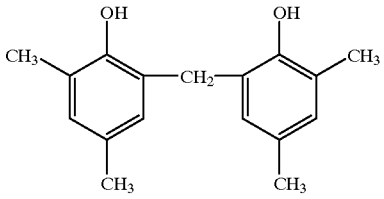

-continued

A-2

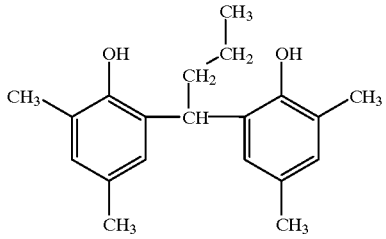

A-3

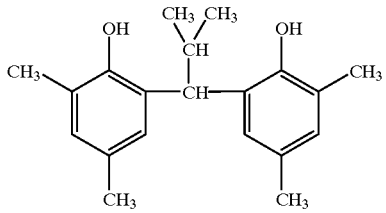

A-4

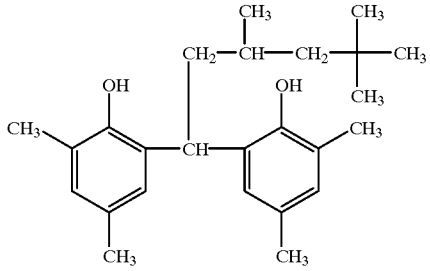

A-5

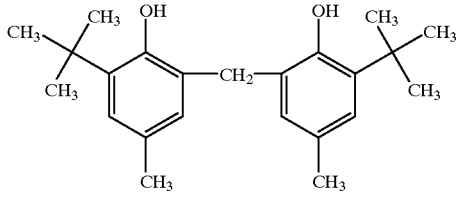

A-6

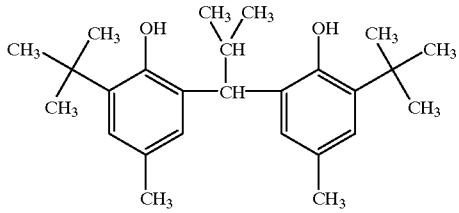

A-7

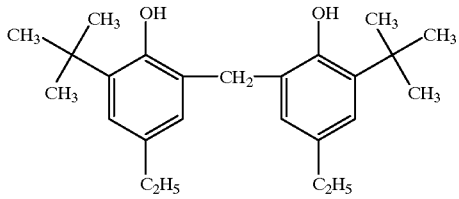

The used amount of reducing agents first represented by the above-mentioned general formula (A) is preferably between $1\times10^{-2}$ and 10 moles per mole of silver, and is most preferably between $1\times10^{-2}$ and 1.5 moles. The thermally developable material has one layer or plural layers on a support and said one layer or plural layers contain organic silver salt, photosensitive silver halide grains and reducing agent. Said organic silver salt, photosensitive silver halide grains and reducing agent may be contained in the same layer or each may be contained in different layer. It is preferable that said organic silver salt and photosensitive silver halide grains are contained in the same layer. The reducing agent is preferably contained in the same layer containing the organic silver salt and the photosensitive silver halide grains or in an adjacent layer.

The thermal developable material preferably contains a hydrazine compound in especially a layer forming an image. Preferable examples of the hydrazine compound include those described in Research Disclosure Item 23515 (November, 1983, Page 346) and other references recited therein such as U.S. Pat. Nos. 4,080,207, 4,269,929, 4,276,364, 41,278,748, 4,385,108, 4,459,347, 4,478,928, 41,560,638, 4,686,167, 4,912,016, 4,988,604, 4,994,365, 5,041,355 and 5,104,769, BP 2,011,1391B, EP 217,310, 301,799 and 356,898, JP OPI Nos. 60-179734, 61-170733, 61-270744, 62-178246, 62-270948, 63-29751, 63-32538, 63-104047, 63-121838, 63-129337, 63-223744, 63-234244, 63-234245, 63-234246, 63-294552, 63-306438, 64- 10233,1-90439, 1-100530, 1-105941, 1-105943, 1-276128, 1-280747, 1-283548, 1-283549, 1-285940, 2-2541, 2-77057, 2-139538, 2-196234, 2-196235, 2-198440, 2-198441, 2-198442, 2-220042, 2-221953, 2-221954, 2-285342, 2-285343, 2-289843, 2-302750, 2-304550, 3-37642, 3-54549, 3-125134, 3-184039, 3-240036, 3-240037, 3-259240, 3-280038, 3-282536, 4-51143, 4-56842, 4-84134, 2-230233, 4-96053, 4-216544, 5-45761, 5-45762, 5-45763, 5-45764, 5-45765, 6-289524 and 9-160164. In addition thereto, compounds described in (Chemical 1), concretely, those described at pages 3 and 4 in Japanese Patent Publication No. 6-77138, those represented by the Formula (1), concretely, compounds 1-38 described at pages 8 to 18 of Japanese Patent Publication No. 6-93082, those represented by the Formulas (4), (5) and (6), concretely, compounds 4-1 to 4-10 described at pages 25 and 26, those represented by the Formulas (4), (5) and (6), concretely, compounds 5-1 to 5-42 described at pages 28 to 36 and those represented by the Formulas (4), (5) and (6), concretely, compounds 6-1 to 6-7 described at pages 39 and 40 of JP OPI No. 6-23049, those represented by the Formulas (1) and (2), concretely, compounds 1-1) to 1-17) and 2-1) described at pages 5 to 7 of JP OPI No. 6-289520, those described in (Chemical 2) and (Chemical 3), concretely, compounds described at pages 6 to 19 of JP OPI No. 6-313936, those described in (Chemical 1), concretely, compounds described at pages 3 to 5 of JP OPI No. 6-313951, those represented by the Formulas (1), concretely, compounds 1-1 to 1-38 described in JP OPI No. 7-5610, those represented by the Formula (11), concretely, compounds 11-1 to 11-102 described at pages 10 to 27 in JP OPI No. 7-77783, and those represented by the Formulas (H) and (Ha), concretely, compounds H-1 to H-44 described at pages 8 to 15 in JP OPI No. 7-104426.

More concretely, hydrazine derivatives represented by the formula Z may be employed.

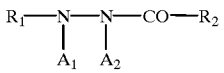

In the formula Z, R1 represents an aliphatic, aromatic or heterocyclic group, R2 represents an alkyl, aralkyl or aryl group, $A_1$ and $A_2$ each represents a hydrogen atom, alkylsulfonyl, aryl sulfonyl or acyl group, provided that both of $A_1$ and $A_2$ are hydrogen atom or one of the $A_1$ and $A_2$ is a hydrogen atom and the other is alkylsulfonyl, aryl sulfonyl or acyl group.

Binders suitable for the thermally developable material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinyl pyrrolidone), casein, starch, poly(acrylic acid), poly(methylmethacrylic acid), poly(vinyl chloride), poly(methacrylic acid), copoly (styrene-maleic acid anhydride), copoly(styrene-acrylonitrile, copoly(styrene-butadiene), poly(vinyl acetal) series (for example, poly(vinyl formal)and poly(vinyl butyral), poly(ester) series, poly(urethane) series, phenoxy resins, poly(vinylidene chloride), poly(epoxide) series, poly (carbonate) series, poly(vinyl acetate) series, cellulose esters, poly(amide) series. These may be hydrophilic or hydrophobic.

In the present invention, with the purpose of minimizing the size variation after thermal development, the amount of the binder in a photosensitive layer is preferably between 1.5 and 10 g/m$^2$, and is more preferably between 1.7 and 8 g/m$^2$. When the amount is below 1.5 g/m$^2$, the density of an unexposed part markedly increases to occasionally cause no commercial viability.

In the present invention, a matting agent may be incorporated in the side of photosensitive layer or backing layer, and is preferably incorporated into photosensitive layer side. In order to minimize the image abrasion after thermal development, the matting agent is provided on the surface of a developable material. The matting agent is preferably incorporated in an amount of 0.5 to 10 percent in weight ratio with respect to the total binder in the emulsion layer side.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc.

Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed.

The size of a matting agent is expressed in the diameter of a sphere which has the same volume as the matting agent. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent.

The variation coefficient of the size distribution as described herein is a value represented by the formula described below.

$$(\text{Standard deviation of grain diameter})/(\text{average grain diameter}) \times 100$$

Addition methods of the matting agent according to the present invention include those in which a matting agent is previously dispersed into a coating composition and is then coated, and prior to the completion of drying, a matting agent is sprayed. When a plurality of matting agents are added, both methods may be employed in combination.

The thermally developable material, to which the present invention is applied, is subjected to formation of photographic images employing thermal development processing and preferably comprises a reducible silver source (organic silver salt), silver halide with an catalytically active amount, a hydrazine derivative, a reducing agent and, if desired, an image color control agent, to adjust silver tone, which are generally dispersed into a (organic) binder matrix.

The thermally developable material according to the present invention forms a photographic image through thermal development, which preferably comprises reduceable silver source (organic silver), light sensitive silver halide, reducing agent and, if necessary, toning agent controlling the color of silver dispersed in a binder matrix. The thermally developable material according to the present invention is stable at normal temperatures and is developed, after exposure, when heated to high temperature (for example, 80–104° C.). Upon heating, silver is formed through an oxidation-reduction reaction between the organic silver salt (functioning as an oxidizing agent) and the reducing agent. This oxidation-reduction reaction is accelerated by the catalytic action of a latent image formed in the silver halide through exposure. Silver formed by the reaction with the organic silver salt in an exposed area yields a black image, which contrasts with an unexposed area to form an image. This reaction process proceeds without the further supply of a processing solution such as water, etc. from outside.

The thermally developable material according to the present invention comprises a support having thereon at least one photosensitive layer. The photosensitive layer may only be formed on the support. Further, at least one non-photosensitive layer is preferably formed on the photosensitive layer. In order to control the amount or wavelength distribution of light transmitted through the photosensitive layer, a filter layer may be provided on the same side as the photosensitive layer, or on the opposite side. Dyes or pigments may also be incorporated into the photosensitive layer. As the dyes, preferred are compounds described in Japanese Patent Publication open to Public Inspection Nos. 59-6481, 59-182436, U.S. Pat. Nos. 4,271,263, 4,594,312, EPA Nos. 533,008, 652,473, Japanese Patent Publication Open to Public Inspection Nos. 2-216140, 4-348,339, 7-191432, and 7-301890, etc.

It is preferable that the protective layer contains a binder mentioned above or a matting agent. The binder is preferably those employed in the image forming layer or those having higher glass transition point than that employed in the image forming layer.

It may contain a lubricant such as polysiloxane compound, wax and fluid paraffin. Preferable thickness of the protective layer is 0.5 to 20.0 $\mu$m, more preferably, 1.5 to 10 $\mu$m.

The non-photosensitive layer may preferably comprises above mentioned binder and matting agent, and further, lubricant as polysiloxane compound, wax or fluid paraffin.

For the exposure to the developable material of the invention Ar ion laser (488 nm), He—Ne laser (633 nm), red semiconductor laser (670 nm), infrared semiconductor laser (760, 780 and 820 nm) are preferably employed. Infrared semiconductor laser is preferably employed because high power can be obtained and developable material is kept transparent.

Exposure is preferably conducted by laser primary scanning, wherein the laser scanning machine so that the angle between the exposure surface of the developable material and scanning laser light is kept not perpendicular.

The photosensitive layer may be composed of a plurality of layers. Furthermore, for gradation adjustment, in terms of sensitivity, layers may be constituted in such a manner as a fast layer/slow layer or a slow layer/fast layer.

Image color control agents are preferably incorporated into the thermally developable material to which the present invention is applied. Examples of suitable image color control agents are disclosed in Research Disclosure Item 17029, and include the following;

imides (for example, phthalimide), cyclic imides, pyrazoline-5-ones, and quinazolinon (for example, succinimide, 3-phenyl-2-pyrazoline-5-one, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis (isothiuroniumtrifluoroacetate), and 2-(tribromomethylsulfonyl)benzothiazole; merocyanine dyes (for example, 3-ethyl-5-((3-ethyl-2-benzothiazolinylidene(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone+benzenesulfinic acid sodium or 8-methylphthalazinone+p-trisulfonic acid sodium); combinations of phthalazine+phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, nartoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

In the present invention, in order to control development, namely to retard or accelerate development, to improve the spectral sensitization efficiency, and to improve keeping quality before and after development, mercapto compounds, disulfide compounds, and thion compounds may be incorporated. When the mercapto compounds are used in the present invention, those having any structure may be employed. However, those represented by ArSM and Ar—S—S—Ar are preferred, wherein M represents a hydrogen atom or an alkali metal atom; Ar represents an aromatic ring or a condensed aromatic ring having at least one of a nitrogen, sulfur, oxygen, selenium or tellurium atom. Preferably, the hetero-aromatic ring is benzimidazole, naphthoimidazole, benzothiazole, naphthothiazole, benzoxazole, naphthoxazole, benzoselenazole, benzotelluzole, imidazole, oxazole, pyrazole, triazole, thiadiazole, tetrazole, triazine, pyrimidine, pyridazine, pyrazine, pyridine, purine, quinoline, quinazoline.

This hetero-aromatic ring may comprise any of those selected from the substituent group consisting of, for example, halogen (for example, Br and Cl), hydroxy, amino, carboxy, alkyl (for example, having at least one carbon atom, or having preferably 1 to 4 carbon atoms), and alkoxy (for example, having at least one carbon atom, or having preferably 1 to 4 carbon atoms). Mercapto substituted hetero-aromatic compounds include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobisbenzothiazole, 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4-(3H)-quinazoline, 7-trifluoromethyl-4-quinolinethiol, 2,3,5,6-tetrachloro-4-pyridinethiol, 4-amino-6-hydroxy-2-mercaptopyridimine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 2-mercapto-4-phenyloxazole, etc.

Antifoggants may be incorporated into the thermally developable material to which the present invention is applied. The substance which is known as the most effective antifoggant is a mercury ion. The incorporation of mercury compounds as the antifoggant into developable materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and Japanese Patent Publication Open to Public Inspection No. 59-57234.

Particularly preferred mercury-free antifoggants are heterocyclic compounds having at least one substituent, represented by —C(X1)(X2)(X3) (wherein X1 and X2 each represents halogen, and X3 represents hydrogen or halogen), as disclosed in U.S. Pat. Nos. 3,874,946 and 4,756,999. As examples of suitable antifoggants, employed preferably are compounds and the like described in paragraph numbers [0062] and [0063] of Japanese Patent Publication Open to Public Inspection No. 9-90550.

Furthermore, more suitable antifoggants are disclosed in U.S. Pat. No. 5,028,523, and U.K. Patent Application Nos. 9221383. No. 4, 9300147. No. 7, and 9311790. No. 1.

In the thermally developable material to which the present invention is applied, employed can be sensitizing dyes described, for example, in Japanese Patent Publication Open to Public Inspection Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, November 1978), 1831, Section X (page 437, August 1978). Particularly, selected can advantageously be sensitizing dyes having the spectral sensitivity suitable for spectral characteristics of light sources of various types of scanners. For example, compounds are preferably employed which are described in Japanese Patent Publication Open to Public Inspection Nos. 9-34078, 9-54409, and 9-80679.

These additive may be incorporated in any layers of photosensitive layer, non- photosensitive layer, or other construction layer. Surfactant, anti-oxidant, stabilizing agent, plasticizer, UV ray absorbing agent, coating aid etc. may be employed in the thermally developable material according to the invention. Examples of these additives and other additives mentioned above, employed preferably in the invention, are described in Research Disclosure Items 17092 (pages 9–15, June 1978).

An electroconductive compound such as metal oxide and/or electroconductive polymer can be incorporated in the composition layers. These may be incorporated in any layers, preferably the subbing layer, the backing layer, the intermediate layer between the photosensitive layer and the subbing layer.

Exposure to the thermally developable photosensitive material of the present invention is preferably carried out using an Ar ion laser (488 nm), a He—Ne laser (633 nm), a red color semiconductor laser (670 nm), an infrared semiconductor laser (760 nm, 780 nm and 820 nm), etc. The infrared semiconductor laser is preferably employed in view of high power, transparency of the photosensitive material or so.

The exposure is preferably conducted by laser scanning exposure. In this occasion it is preferable to employ an exposing apparatus that the angle formed between the surface of the photosensitive material and laser light is not substantially perpendicular during exposure. The angle is preferably 55–88°, more preferably 60–86°, further preferably 65–84°, and most preferably 70–82°.

Spot diameter of the laser beam when scanning on the photosensitive material is preferably not more than 200 $\mu$m, more preferably not more than 100 $\mu$m. The smaller spot diameter is preferable because of reducing the angle difference from perpendicular point of angle of incidence.

The lower limit of the spot diameter of the laser beam is about 10 $\mu$m. By employing such a laser scanning exposure, image deterioration such as mottle of interference stripes caused by reflecting light when exposed by laser scanning can be reduced.

It is also preferable to employ an laser scanning exposure apparatus which emit longitudinal multiple mode scanning laser light. In this occasion image deterioration such as mottle of interference stripes can be reduced in comparison with longitudinal single mode laser light.

To make the light longitudinally multiple, a method is employed such as synthesizing waves, employing returning light, superposing high frequency wave. The longitudinally multiple light means that the exposure wave length is not simple, and has distribution of wavelength of not less than 5 nm, preferably 10 nm. The upper limit of the distribution of wavelength is usually 60 nm, for example.

EXAMPLES

The present invention is explained with reference to examples below. However, the present invention is not limited to these examples.

Example 1

(Preparation of a Plastic Support Covered with a Polyimide Resin on both Surface)

Plastic film shown in Table 1 having 100 $\mu$m was coated with polyimide resin shown in Table 1 dissolved in N-methylpyrrolidone so as to have the dryad thickness shown in Table 1 on both side.

(Preparation of a Photographic Subbed Support)

The support obtained above was subjected to corona discharging treatment of 8 w/m$^2$.minute on both sides. Onto the surface of one side, the subbing coating composition a-1 described below was applied and dried so as to form a dry thickness of 0.8 μm and the resulting coating was designated Subbing Layer A-1. Furthermore, onto the opposite side surface, the subbing coating composition b-1 described below was applied, so as to form a dry thickness of 0.8 μm, and the resulting coating was designated Subbing Layer B-1.

| | |
|---|---|
| <Subbing Coating Composition a-1> | |
| Latex composition (solid portion of 30 percent of a copolymer composed of butyl acrylate (30 weight percent), t-butyl acrylate (20 weight percent), styrene (25 weight percent), and 2-hydroxyethyl acrylate (25 weight percent) | 270 g |
| (C-1) | 0.6 g |
| Hexamethylene-1,6-bis(ethyleneurea) | 0.8 g |
| Water to make | 1 liter |
| <Subbing Coating Composition b-1> | |
| Latex composition (solid portion of 30 percent of a copolymer composed of butyl acrylate (40 weight percent), styrene (20 weight percent), and glycidyl acrylate (40 weight percent) | 270 g |
| (C-1) | 0.6 g |
| Hexamethylene-1,6-bis(ethyleneurea) | 0.8 g |
| Water to make | 1 liter |

Subsequently, the surfaces of subbing layers A-1 and B-1 were subjected to corona discharging of 8 w/m$^2$.minute, and onto the subbing layer A-1, the subbing upper layer coating composition a-2 described below was coated to form subbing layer A-2 so as to obtain a dried thickness of 0.1 μm, and onto the subbing layer B-1, the antistatic treatment subbing upper layer coating composition b-2 described below was coated to form antistatic treatment subbing upper layer B-2 exhibiting antistatic function so as to obtain a dried thickness of 0.8 μm.

| | |
|---|---|
| (Subbing Upper Layer Coating Composition a-2) | |
| Gelatin | weight to make 0.4 g/m$^2$ |
| (C-1) | 0.2 g |
| (C-2) | 0.2 g |
| (C-3) | 0.1 g |
| Silica particles (average diameter of 3 μm) | 0.1 g |
| Water to make | 1 liter |
| (Subbing Upper Layer Coating Composition b-2) | |
| (C-4) | 60 g |
| Latex composition comprising (C-5) as a component (solid portion of 20 percent) | 80 g |
| Ammonium sulfate | 0.5 g |
| (C-6) | 12 g |
| Polyethylene glycol (weight average molecular weight of 600) | 6 g |
| Water to make | 1 liter |

(C-1)

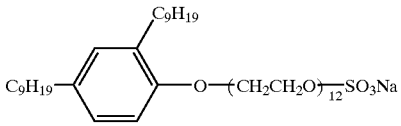

(C-2)

-continued

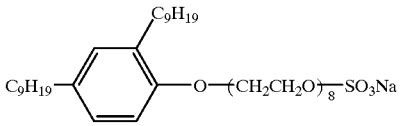

(C-3)

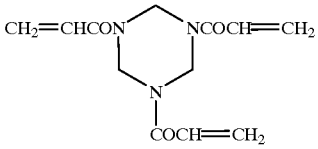

(C-4)

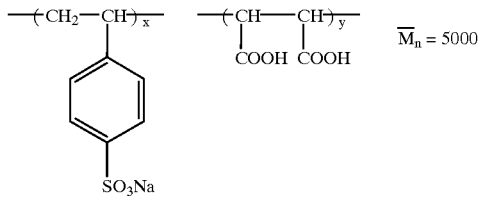

($\overline{M}$n is number average molecular weight)
x:y = 75:25 (weight ratio)

(C-5)

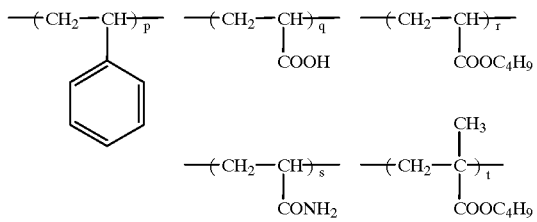

p:q:r:s:t = 40:5:10:5:40 (Weight ratio)

(C-6)

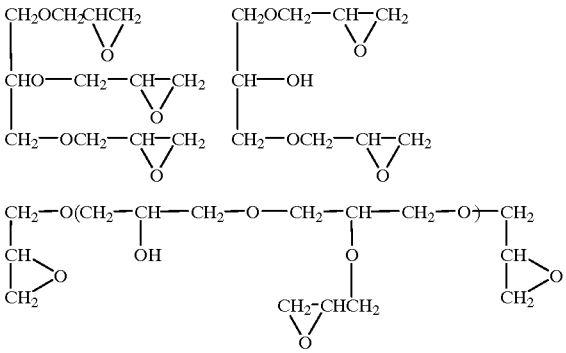

Mixture of three compounds above (Preparation of Emulsion A)

In 900 ml of water, 7.5 g of inert gelatin and 10 mg of potassium bromide were dissolved. After adjusting the temperature to 35° C. and the pH to 3.0, 370 ml of an aqueous solution containing 74 g of silver nitrate, an aqueous solution containing potassium bromide and potassium iodide in a mole ratio of 98/2, $1\times10^{-6}$ mole of $Ir(NO)Cl_6$ salt per mole of silver, and $1\times10^{-4}$ mole of rhodium chloride salt per mole of silver were added employing a controlled double-jet method while maintaining the pAg at 7.7. Subsequently, 4-hydroxy-6-methyl-1,3,3a,7-tetraazaindene was added and the pH was adjusted to 5 using NaOH. Thus, obtained was cubic silver iodobromide grains having an average grain size of 0.06 μm, a projection diameter area variation coefficient of 8 percent, and a [100] plane ratio of 87 percent. The resulting emulsion was subjected to desalting through coagulation precipitation employing an coagulant. After that, 0.1 g of phenoxyethanol was added, and the pH and pAg were adjusted to 5.9 and 7.5, respectively to obtain a silver halide emulsion A.

Behenate silver was prepared in accordance with a method described in Example 1 of Japanese Patent Publication Open to Public Inspection No. 9-127643.

(Preparation of Sodium Behenate Solution)

To 340 ml of isopropanol, 34 g of behenic acid was dissolved at 65° C. Thereafter, with stirring, an aqueous 0.25N sodium hydroxide solution was added so that the pH was adjusted to 8.7. At the time, about 400 ml of an aqueous sodium hydroxide solution was employed. Thereafter, the resulting sodium behenate solution was concentrated under reduced pressure so that the concentration of sodium behenate became 8.9 percent by weight.

(Preparation of Silver Behenate)

To a solution prepared by dissolving 30 g of ossein gelatin in 750 ml distilled water, a 2.94M silver nitrate solution was added to result in a silver electrical potential of 400 mV. To the resulting solution, 374 ml of the above-mentioned sodium behenate solution was added at 78° C. employing a controlled double-jet method along with an aqueous 2.94M silver nitrate solution at the same time. During the addition, the added amounts of sodium behenate and silver nitrate were 0.092 mole and 0.101 mole, respectively. After the addition, stirring continued for more 30 minutes and water-soluble salts were removed using ultrafiltration.

The resulting silver behenate was composed of needle grains having an average grain size of 0.8 μm and a monodispersibility of 8 percent.

(Preparation of Photosensitive Emulsion B)

To the resulting silver behenate dispersion, 0.01 mole of the above-mentioned silver halide emulsion A was added. With continuous stirring, dispersion flocks were formed by gradually adding 100 g of a n-butyl acetate solution containing vinyl acetate (1.2 percent by weight). Subsequently, water was removed and further, water washing and water removal were carried out two more times. Then, with stirring, added was 60 g of a mixture consisting of 2.5 weight percent polyvinyl butyral (average molecular weight of 3,000) as a binder in butyl acetate containing isopropyl alcohol in a ratio of 1:2. Thereafter, a gel-like mixture consisting of behenic acid and silver halide, as prepared above, was added with polyvinyl butyral (average molecular weight of 4,000) as a binder in isopropyl alcohol, and was dispersed to obtain photosensitive emulsion B.

Onto the supports shown in Table 1, each layer described below was subsequently applied to prepare samples 1–17. Each sample was dried at 75° C. for 5 minutes.

(Coating Onto Back Side Surface)

The composition described below was coated to form a wet thickness of 80 μm.

| | |
|---|---|
| Polyvinyl butyral (10 percent isopropanol solution) | 150 ml |
| Dye-B | 70 mg |
| Dye-C | 70 mg |

Dye-B

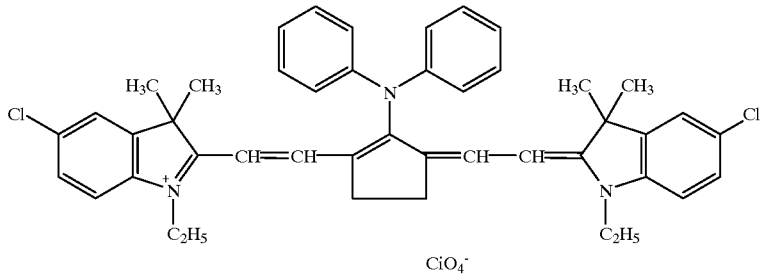

Dye-C

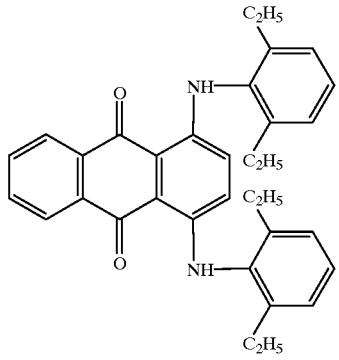

(Coating Onto Surface of Photosensitive Layer Side)

Photosensitive Layer 1:

The composition described below was coated so that the coated silver amount was 3.0 g/m$^2$ and polyvinyl butyral as a binder was 8 g/m$^2$.

| | |
|---|---|
| Photosensitive emulsion B as silver, amount to make | 3.0 g/m$^2$ |
| Sensitizing dye-1 (0.1% DMF solution) | 2 mg |
| Antifoggant-1 pyridiniumhydrobromideperbromide (0.01% methanol solution) | 3 ml |
| Antifoggant-2 (1.5% methanol solution) | 8 ml |
| Antifoggant-3 2-tribromomethylsulfonylquinoline (2.4% DMF solution) | 5 ml |
| Phthalazone (4.5% DMF solution) | 8 ml |
| Developing agent-1 (10% acetone solution) | 20 ml |
| Contrast enhancing agent H-1 (1% methanol/DMF = 4:1) | 2 ml |

Sensitizing dye-1

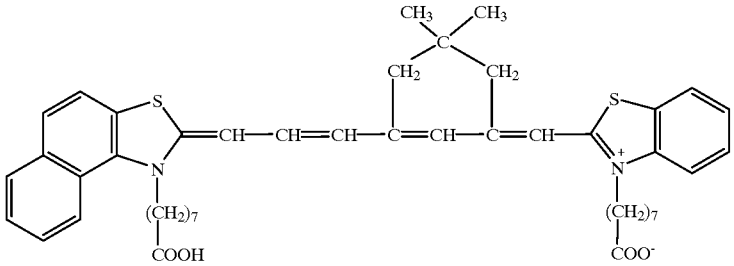

Antifoggant-2

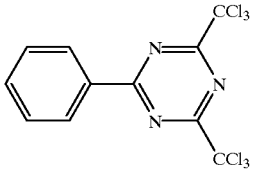

Developing agent-1

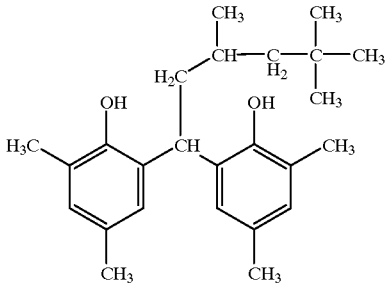

Contrast enhancing agent H-1

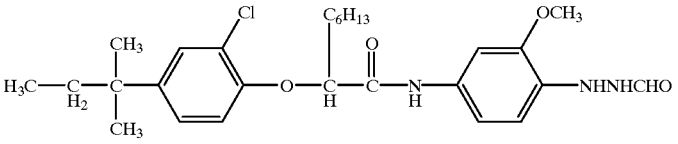

Contrast enhancing agent H-2

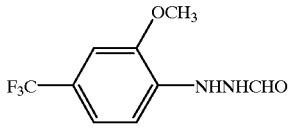

Surface Protective Layer:

The composition described below was coated onto the photosensitive layer so as to obtain a wet thickness of 100 $\mu$m.

| | |
|---|---|
| Acetone | 175 ml |
| 2-Propanol | 40 ml |
| Methanol | 15 ml |
| Cellulose acetate | 8.0 g |
| Phthalazine | 1.0 g |

-continued

| | |
|---|---|
| 4-Methylphthalic acid | 0.72 g |
| Tetrachlorophthalic acid | 0.22 g |
| Tetrachlorophthalic acid anhydride | 0.5 g |
| Matting agent: silica with an average grain size of 4 $\mu$m | 0.5 g |

(Evaluation on Staining)

The thermally developable material prepared as above was visually evaluated. No staining was evaluated to be Rank 5. As staining increases, Rank decreases as 4, 3, 2, and 1. Rank 1 indicates the formation of dense brown staining. Those which do not reach Rank 3 are not commercially viable.

After a thermally developable photosensitive sample as prepared above was allowed to stand at 23° C., 48% R.H. for 2 days, smooster value of the surface was measured by using a smooster meter, SM-6B produced by Toei Denki Kogyo Co., Ltd. The smooster value of the surface of the uppermost layer on the emulsion layer side was 20 mmHg and that of the surface of the uppermost layer on the backing layer side was 120 mmHg. And after the thermally developable photosensitive sample was allowed to stand at 23° C., 50% R.H. for 2 days, hardness value of the protective layer was measured by using a thin layer hardness meter produced by Nihon Denki Co., Ltd. The obtained hardness value of the protective layer was 1.1 GPa.

(Measurement of Size Repetition Accuracy)

A thermally developable photosensitive sample as prepared above was subjected to image exposure of two fine lines with an interval of 500 mm using an image setter having a 760 nm semiconductor laser. Thereafter, thermal development was carried out employing a heat drum at 130° C. for 25 seconds. At the time, exposure and development were carried out in a room conditioned at 23° C. and RH 50%. This operation was repeated four times and the distance between two fine lines was accurately measured. In that case, R represents the difference between the maximum and the minimum and the size repetition accuracy T was obtained in accordance with the formula described below.

$$T=(R/W)\times 100(\%)$$

W: length of a sample prior to development

Table 1 show the evaluation results. In case that the repetition accuracy is not within 0.1 percent, application to color printing is not viable.

Table 1 shows the evaluation results.

TABLE 1

| No. | Support | Coated polyimide resin No. | Thickness (μm) | Staining | Size repetition accuracy (%) | Remarks |
|---|---|---|---|---|---|---|
| 1 | (a) | — | — | 1 | 0.01 | Comparative |
| 2 | PET | — | — | 5 | 0.8 | Comparative |
| 4 | PET | PI-9 | 0.5 | 5 | 0.08 | Invention |
| 5 | PET | PI-9 | 1.0 | 4 | 0.06 | Invention |
| 6 | PET | PI-9 | 3.0 | 4 | 0.04 | Invention |
| 8 | PET | PI-1 | 1.0 | 4 | 0.07 | Invention |
| 9 | PET | PI-8 | 1.0 | 5 | 0.06 | Invention |
| 10 | PET | PI-14 | 1.0 | 4 | 0.06 | Invention |
| 11 | PET | PI-16 | 1.0 | 5 | 0.06 | Invention |
| 12 | PEN | — | — | 5 | 0.11 | Comparative |
| 13 | PEN | PI-9 | 1.0 | 4 | 0.05 | Invention |
| 14 | PEN | PI-16 | 1.0 | 5 | 0.05 | Invention |
| 15 | SPS | — | — | 5 | 0.11 | Comparative |
| 16 | SPS | PI-9 | 1.0 | 4 | 0.05 | Invention |
| 17 | SPS | PI-16 | 1.0 | 5 | 0.05 | Invention |

(a) KAPTON film (Polyetherimide having 100 μm thickness, product of Du Pont Co. Ltd.)

The thermal shrinkage ratio (150° C., 30 minutes) is listed.

| No. | thermal shrinkage ratio (%) |
|---|---|
| 4 | 0.017 |
| 5 | 0.012 |
| 6 | 0.010 |
| 8 | 0.014 |
| 9 | 0.012 |
| 10 | 0.012 |
| 11 | 0.013 |
| 13 | 0.012 |
| 14 | 0.013 |
| 16 | 0.012 |
| 17 | 0.013 |

The thermal shrinkage ratio is dimensional shrink ratio after 30 minutes standing at 150° C. at the coated thickness.

Table 1 demonstrates the samples according to the invention are transparent without staining and advantageous in Size Repetition Accuracy.

Further, the other size repetition accuracy test was conducted for the sample prepared above in the following way.

The samples of thermally developable material were exposed by employing an image setter having 760 nm semiconductor laser so that the exposing angle is 80° and two fine lines were exposed with a distance of 500 mm. The samples were processed. The processing apparatus comprises two sets of device in series having plurality of rollers positioned alternatively so that the developable material is transported straight in a heated thermally insulating chamber. The samples were processed through the first device at 70° C., 10 second (preheating) and just after that the second device at 130° C., 15 seconds (development). The exposure and the processing was conducted in an air conditioned room at 23° C., 50% RH. The processing was repeated four times, and then the distance of the two lines on the samples was measured. Size repetetion accuracy was evaluated in the same way as mentioned above. The result is listed. Sample numbers are the same as above.

| No. | Size repetition accuracy (%) |
|---|---|
| 1 | 0.01 |
| 2 | 0.7 |
| 4 | 0.07 |
| 5 | 0.04 |
| 6 | 0.03 |
| 8 | 0.06 |
| 9 | 0.06 |
| 10 | 0.04 |
| 11 | 0.05 |
| 12 | 0.10 |
| 13 | 0.03 |
| 14 | 0.04 |
| 15 | 0.10 |
| 16 | 0.04 |
| 17 | 0.04 |

This example demonstrates that the samples of the invention is excellent in size repetition accuracy.

Example 2

Onto the surface of one side of PET film having 100 μm thickness, resins according to the invention shown in Table 2 dissolved in N-methylpyrroridone were coated so as to have dry thickness of 1.0 μm.

Employing the film prepared above as a support, thermal developable material was prepared as that a photosensitive layer, a protective layer and a backing layer were coated thereon, after providing a subbing layer, in the same way as in Example 1, except that the contrast enhancing agent H was replaced by contrast enhancing agent N shown below.

Contrast enhancing agent N

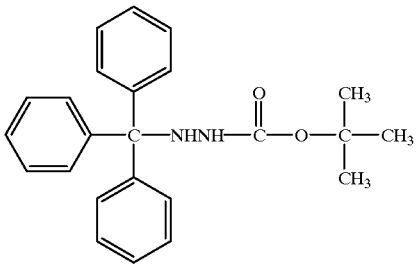

For the obtained samples evaluation of staining and size repetition accuracy was measured shown as Example 1. At that time thermal processing condition was 140° C. for 10 seconds.

The result of evaluation was shown in Table 2.

TABLE 2

| Sample No. | Support | Coated polyimide resin No. | Staining | size repetition accuracy (%) | Remarks |
|---|---|---|---|---|---|
| 1 | (a) | — | 1 | 0.01 | Comparative |
| 2 | PET | — | 5 | 0.8 | Comparative |
| 3 | PET | PI-9 | 4 | 0.06 | Invention |
| 4 | PET | PI-16 | 4 | 0.06 | Invention |
| 5 | PET | PI-18 | 5 | 0.06 | Invention |
| 6 | PET | PI-20 | 5 | 0.05 | Invention |
| 7 | PET | PI-21 | 5 | 0.06 | Invention |

(a) KAPTON film (Polyetherimide having 100 μm thickness, product of Du Pont Co. Ltd.)

Thermal shrinkage ratio (150° C., 30 minutes) is listed.

| No. | thermal shrinkage ratio (%) |
|---|---|
| 3 | 0.012 |
| 4 | 0.013 |
| 5 | 0.013 |
| 6 | 0.010 |
| 7 | 0.012 |

The thermal shrinkage ratio is dimensional shrink ratio after 30 minutes standing at 150° C. at the coated thickness.

Table 2 demonstrates the samples according to the invention are transparent without staining and advantageous in Size Repetition Accuracy, and the more the cyclo ring component increases, the more advantageous in staining.

Example 3

Both sides of a plastic film of PET having 100 μm thickens shown in Table 3 were subjected by corona discharge at 8 w/m$^2$.minute, and then, an adhesive layer was provided by that the coating composition 'a' shown below was coated so as to have dry thickness of 0.8 μm.

| <Coating Composition a> | |
|---|---|
| Latex composition (solid portion of 30 percent of a copolymer composed of butyl acrylate (30 weight percent), t-butyl acrylate (20 weight percent), styrene (25 weight percent), and 2-hydroxyethyl acrylate (25 weight percent) | 270 g |
| (C-1) | 0.6 g |
| Hexamethylene-1,6-bis (ethyleneurea) | 0.8 g |
| Water to make | 1 liter |

Subsequently surfaces of both sides were subjected by corona discharge at 8 w/m$^2$.min., further, coating composition 'b' which is aqueous solution or aqueous dispersion composed of the resin of the invention shown below was coated so as to have a dry thickness of 1.0 μm.

| | |
|---|---|
| Resin composition of the invention (shown in Table 3) (solid portion of 30 percent) | 200 g |
| Polyethylacrylate (solid portion of 30 percent) | 30 g |
| (C-1) | 0.6 g |
| (C-6) | 5 g |
| Water to make | 1 liter |

Subsequently, surfaces of both sides were subjected by corona discharge at 8 w/m$^2$.minute, and then, a layer was provided by that the coating composition 'a-2' shown below was coated so as to have dry thickness of 0.1 μm for a side of photosensitive layer, and another layer having an anti-static function was provided by that the coating composition 'b-2' shown below was coated so as to have dry thickness of 0.8 μm for a back side.

| <Coating Composition a-2> | |
|---|---|
| Gelatin | weight to make 0.4 g/m$^2$ |
| (C-1) | 0.2 g |
| (C-2) | 0.2 g |
| (C-3) | 0.1 g |
| Silica particles (average diameter of 3 μm) | 0.1 g |
| Water to make | 1 liter |
| <Coating Composition b-2> | |
| (C-4) | 60 g |
| Latex composition comprising (C-5) as a component (solid portion of 20 percent | 80 g |
| Ammonium sulfate | 0.5 g |
| (C-6) | 12 g |
| Polyethylene glycol (weight average molecular weight of 600) | 6 g |
| Water to make | 1 liter |

Employing the film prepared above as a support, thermal developable material was prepared as that a photosensitive layer, a protective layer and a backing layer were coated thereon, after providing a subbing layer, in the same way as in Example 2.

For the obtained samples evaluation of staining and size repetition accuracy was measured shown as Example 2.

The result of evaluation was shown in Table 3.

TABLE 3

| Sample No. | Support | Coating composition: Coated polyimide resin No. | Coating composition: Thickness (μm) | Staining | Size repetition accuracy (%) | Remarks |
|---|---|---|---|---|---|---|
| 1 | (a) | — | — | 1 | 0.01 | Comparative |
| 2 | PET | — | — | 5 | 0.9 | Comparative |
| 4 | PET | SP-6 | 0.5 | 5 | 0.09 | Invention |
| 5 | PET | SP-6 | 1.0 | 4 | 0.07 | Invention |
| 6 | PET | SP-6 | 3.0 | 3 | 0.05 | Invention |
| 8 | PET | SP-2 | 1.0 | 4 | 0.08 | Invention |
| 9 | PET | SP-7 | 1.0 | 5 | 0.06 | Invention |
| 10 | PET | SP-9 | 1.0 | 5 | 0.06 | Invention |
| 11 | PET | SP-12 | 1.0 | 5 | 0.07 | Invention |
| 12 | PEN | — | — | 5 | 0.12 | Comparative |
| 13 | PEN | SP-6 | 1.0 | 4 | 0.06 | Invention |
| 14 | PEN | SP-7 | 1.0 | 5 | 0.05 | Invention |
| 15 | PEN | SP-9 | 1.0 | 5 | 0.05 | Invention |
| 16 | SPS | — | — | 5 | 0.12 | Comparative |
| 17 | SPS | SP-6 | 1.0 | 4 | 0.06 | Invention |
| 18 | SPS | SP-7 | 1.0 | 5 | 0.05 | Invention |
| 19 | SPS | SP-9 | 1.0 | 5 | 0.05 | Invention |

(a) KAPTON film (Polyetherimide having 100 μm thickness, product of Du Pont Co. Ltd.)

The thermal shrinkage ratio (150° C., 30 minutes) is listed.

| No. | thermal shrinkage ratio (%) |
|---|---|
| 4 | 0.020 |
| 5 | 0.015 |
| 6 | 0.013 |
| 8 | 0.018 |
| 9 | 0.014 |
| 10 | 0.013 |
| 11 | 0.015 |
| 13 | 0.015 |
| 14 | 0.014 |
| 15 | 0.013 |
| 17 | 0.015 |
| 18 | 0.014 |
| 19 | 0.013 |

The thermal shrinkage ratio is dimensional shrink ratio after 30 minutes standing at 150° C. at the coated thickness.

Table 3 demonstrates the samples according to the invention are transparent without staining and advantageous in Size Repetition Accuracy.

Example 4

Both sides of PET film Sample Nos. 5 and 8–11 coated with the e resin of the invention prepared in Example 3 were subjected by corona discharge at 8 w/m$^2$.minute, and then, thermal developable material was prepared as that a photosensitive layer, a protective layer and a backing layer were coated thereon.

(Preparation of Emulsion A)

In 900 ml of water, 7.5 g of inert gelatin and 10 mg of potassium bromide were dissolved. After adjusting the temperature to 35° C. and the pH to 3.0, 370 ml of an aqueous solution containing 74 g of silver nitrate, an aqueous solution containing potassium bromide and potassium iodide in a mole ratio of 98/2, $1\times10^{-6}$ mole of $Ir(NO)Cl_6$ salt per mole of silver, and $1\times10^{-4}$ mole of rhodium chloride salt per mole of silver were added employing a controlled double-jet method while maintaining the pAg at 7.7. Subsequently, 4-hydroxy-6-methyl-1,3,3a,7-tetraazaindene was added and the pH was adjusted to 5 using NaOH. Thus, obtained was cubic silver iodobromide grains having an average grain size of 0.06 μm, a projection diameter area variation coefficient of 8 percent, and a [100] plane ratio of 87 percent. The resulting emulsion was subjected to desalting through coagulation precipitation employing an coagulant. After that, 0.1 g of phenoxyethanol was added, and the pH and pAg were adjusted to 5.9 and 7.5, respectively to obtain a silver halide emulsion.

<Preparation of Polymer Silver Emulsion>

Taking aqueous dispersion of methacrylic acid/n-butylacrylate/ethyleneglycoldimethacrylate (30/60/10) copolymer so that the solid amount corresponded to 25 mmol of acid radical, distilled water was added to make 300 ml. Aqueous solution of 1N sodium hydroxide was added to this for 15 minutes to make pH of 8.7. Keeping temperature at 30° C., 7 ml of aqueous solution of 1N phosphoric acid was added, 0.02 g of N-bromosuccinimide was added with vigorous agitation, then silver halide emulsion A prepared above was added so that the amount of the silver halide becomes 2.05 mmol. The resulted composition was added to solution composed of 10 g of ossein gelatin, 1 g of polyoxyethylenedodecylphenylether (average ethylene unit is 8) and 25 ml of aqueous solution of 1N silver nitrate dissolved in 500 ml of distilled water at 78° C. for taking 30 minutes. After the completion of addition, it was agitated for 30 minutes, then water soluble salt was removed so that the conductivity of the filtered water was 30 μS/cm by means of ultrafiltration.

<Coating of Backing Side>

Backing Layer

Coating composition prepared by adding the aqueous dispersion of composition described below to water was coated so as to make coating amount shown below, then dried. Content of organic solvent in coating composition was 0.5 wt % based on water because small amount of DMF was required for dispersing dye in water.

| | |
|---|---|
| Cellulose acetate | 7.0 g/m$^2$ |
| Dye-B | 70 mg/m$^2$ |
| Dye-C | 70 mg/m$^2$ |

<Photosensitive Side>

Photosensitive Layer

Coating composition prepared by adding the aqueous dispersion of composition described below to water was coated so as to make coating amount shown below, then dryad.

| | |
|---|---|
| Polymer silver emulsion | Silver amount to make 2.0 g/m$^2$ |
| Binder (Sum amount of polymer component contained in the polymer silver described above and polyvinylbutyral) | 5.0 g/m$^2$ |
| Optical sensitizing Dye-1 | 2 mg/m$^2$ |
| Antifoggant-1 pyridiniumhydrobromideperbromide | 0.3 mg/m$^2$ |
| Antifoggant-2 | 1.2 mg/m$^2$ |
| Antifoggant-3 2-tribromomethylsulfonylquinolin | 120 mg/m$^2$ |
| Phthalazone | 360 mg/m$^2$ |
| Developing agent-1 | 1300 mg/m$^2$ |
| Contrast enhancing agent | 100 mg/m$^2$ |

Content of organic solvent in coating composition was 1.0 wt % based on water because small amount of DMF was required for dispersing dye in water.

Surface Protective Layer

Coating composition prepared by adding the aqueous dispersion of composition described below to water was coated so as to make coating amount shown below, then dryad.

| | |
|---|---|
| Cellulose acetate | 2.0 g/m$^2$ |
| Phthalazine | 1.0 g/m$^2$ |
| 4-Methylphthalic acid | 0.72 /m$^2$ g |
| Tetrachlorophthalic acid | 0.22 g/m$^2$ |
| Tetrachlorophthalic acid anhydride | 0.5 g/m$^2$ |
| Matting agent: silica with an average grain size of 5 $\mu$m | 2.0 g m$^2$ |

Content of organic solvent in coating composition was 0.9 wt % based on water because small amount of DMF was required for dispersing dye in water.

The resulted thermal developable materials were evaluated in staining and size repetition accuracy in the same way as Example 3. It was found that the same results as Examples 3 were obtained and the samples according to the invention were transparent without staining and advantageous in size repetition accuracy.

Example 5

Example 1 was repeated except that the plastic support and photosensitive layer were modified as described below.

(Preparation of a Plastic Support Covered with a Resin on both Surface)

On both sides plastic film shown in Table 4 having 100 $\mu$m resin shown in Table 4 was provided by coating dissolved in tetrahydrofurane so as to have the dried thickness shown in Table 4, or by drawing the fused and extruded resin with the plastic base simultaneously so as to have a predetermined thickness.

(Coating Onto Surface of Photosensitive Layer Side)

Photosensitive Layer

The composition described below was coated so that the coated silver amount was 2.0 g/m$^2$ and polyvinyl butyral as a binder was 8 g/m$^2$.

| | |
|---|---|
| Photosensitive emulsion B as silver, amount to make | 2.0 g/m$^2$ |
| Sensitizing dye-1 (0.1% DMF solution) | 2 mg |
| Antifoggant-1 pyridiniumhydrobromideperbromide (0.01% methanol solution) | 3 ml |
| Antifoggant-2 (1.5% methanol solution) | 8 ml |
| Antifoggant-3 2-tribromomethylsulfonylquinoline (2.4% DMF solution) | 5 ml |
| Phthalazone (4.5% DMF solution) | 8 ml |
| Developing agent-1 (10% acetone solution) | 20 ml |
| Contrast enhancing agent H-1 (1% methanol/DMF = 4:1) | 2 ml |
| Contrast enhancing agent H-2 (1% methanol/DMF = 4:1) | 2 ml |

Sensitizing dye-1

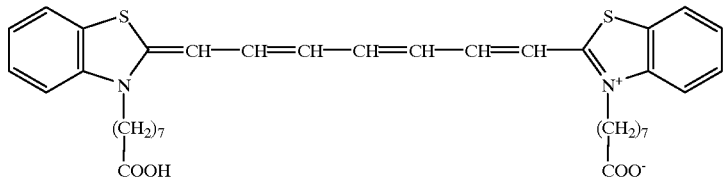

Contrast enhancing agent H-2

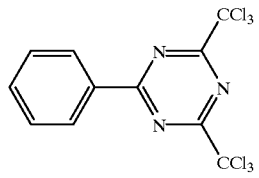

The same evaluation as Example 1 was conducted. The result is summarized in Table 4.

TABLE 4

| | | Coated polyimide resin | | | | Size |
|---|---|---|---|---|---|---|
| No. | Support | No. | Thickness ($\mu$m) | Thermal shrinkage ratio (%) | Staining | repetition accuracy (%) |
| 1 | (a) | — | — | | 1 | 0.01 |
| 2 | PET | — | — | | 5 | 0.80 |
| 3 | PET | (b) | 1.0 | 0.015 | 5 | 0.09 |
| 4 | PET | (c) | 1.0 | 0.007 | 5 | 0.06 |
| 6 | PET | T-1 | 0.5 | 0.003 | 5 | 0.08 |
| 7 | PET | T-1 | 1.0 | 0.002 | 4 | 0.06 |
| 8 | PET | T-1 | 3.0 | 0.002 | 4 | 0.04 |
| 10 | PET | T-3 | 1.0 | 0.003 | 4 | 0.06 |
| 11 | PET | T-5 | 1.0 | 0.002 | 5 | 0.05 |
| 12 | PET | T-7 | 1.0 | 0.011 | 4 | 0.07 |
| 13 | PET | T-8 | 1.0 | 0.013 | 4 | 0.08 |
| 14 | PEN | — | — | | 5 | 0.11 |
| 15 | PEN | T-1 | 1.0 | 0.002 | 4 | 0.04 |
| 16 | PEN | T-7 | 1.0 | 0.010 | 5 | 0.05 |
| 17 | SPS | — | — | | 5 | 0.11 |
| 18 | SPS | T-1 | 1.0 | 0.003 | 4 | 0.04 |
| 19 | SPS | T-8 | 1.0 | 0.011 | 5 | 0.05 |

(a) KAPTON film (Polyetherimide having 100 $\mu$m thickness, product of Du Pont Co. Ltd.)
(b) Fused extrusion coating of polymethylmethacrylate (Tg: 105° C.)
(c) Fused extrusion coating of ARTON film (Polynobornane Tg: 171° C., Product by JSR Co.)
The shrinkage ratio is dimensional shrink ratio after 30 minutes standing at 150° C.

It was found that the samples according to the invention were transparent without staining and advantageous in size repetition accuracy.

According to the invention a thermally developable material is provided, which is colorless, transparent and excellent in repetitive size accuracy, and specifically to a thermally developable material for plate-making suitable for color printing.

Disclosed embodiment can be varied by a skilled person without departing from the spirit and scope of the invention.

What is claimed is:

1. A thermally developable material comprising a binder, a reducing agent, and on a support, both surfaces of said support being coated with a resin layer having a thermal shrinkage ratio not exceeding 0.02% at 150° C. for 30 minutes, and an image forming layer comprising an organic silver salt.

2. The thermally developable material of claim 1 wherein said resin has no glass transition point.

3. The thermally developable material of claim 1 wherein said resin has glass transition point of at least a temperature of thermal development.

4. The thermally developable material of claim 1 wherein said resin has glass transition point of at least 100° C.

5. The thermally developable material of claim 1 wherein the resin is an inorganic and organic hybrid, said hybrid containing silica.

6. The thermally developable material of claim 1 wherein said resin is a polymer containing an organosilsesquioxane unit or silicate unit.

7. The thermally developable material of claim 1 wherein a thickness of said resin layer on each side is 0.25 to 4 $\mu$m.

8. The thermally developable material of claim 1 wherein said resin is a polyimide.

9. The thermally developable material of claim 8 wherein a thickness of said resin layer on each side is 0.25 to 4 $\mu$m.

10. The thermally developable material of claim 8 wherein said polyimide resin contains a ring.

11. The thermally developable material of claim 8 wherein said polyimide resin contains a water soluble group.

12. The thermally developable material of claim 1 wherein said resin contains a water soluble group.

13. The thermally developable material of claim 12 wherein said resin contains a polyimide skeleton or a ring.

14. The thermally developable material of claim 12 wherein a thickness of said resin layer on each side is 0.25 to 4 $\mu$m.

15. The thermally developable material of claim 1 wherein said image forming layer comprises silver halide.

* * * * *